US007621621B2

(12) United States Patent
Iwasaki et al.

(10) Patent No.: US 7,621,621 B2
(45) Date of Patent: Nov. 24, 2009

(54) INK JET PRINTING APPARATUS

(75) Inventors: Osamu Iwasaki, Tokyo (JP); Kiichiro Takahashi, Kanagawa (JP); Hitoshi Nishikori, Tokyo (JP); Naoji Otsuka, Kanagawa (JP); Minoru Teshigawara, Kanagawa (JP); Tetsuya Edamura, Kanagawa (JP); Yoshinori Nakagawa, Kanagawa (JP); Satoshi Seki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 179 days.

(21) Appl. No.: 10/864,356

(22) Filed: Jun. 10, 2004

(65) Prior Publication Data

US 2005/0018012 A1 Jan. 27, 2005

(30) Foreign Application Priority Data

Jun. 13, 2003 (JP) ..... 2003-169969

(51) Int. Cl.
*B41J 2/21* (2006.01)
*B41J 2/175* (2006.01)

(52) U.S. Cl. ..... 347/43; 347/85

(58) Field of Classification Search ..... 347/43, 347/9, 85–86

See application file for complete search history.

(56) References Cited

U.S. PATENT DOCUMENTS

| | | | | |
|---|---|---|---|---|
| 4,593,295 | A | 6/1986 | Matsufuji et al. | 347/41 |
| 4,952,942 | A | 8/1990 | Kanome et al. | 347/15 |
| 5,604,520 | A | 2/1997 | Matsubara et al. | 347/43 |
| 5,818,474 | A | 10/1998 | Takahashi et al. | 347/15 |
| 5,852,454 | A | 12/1998 | Kanematsu et al. | 347/43 |
| 6,007,181 | A | 12/1999 | Takahashi et al. | 347/41 |
| 6,042,212 | A | 3/2000 | Takahashi et al. | 347/15 |
| 6,053,595 | A | 4/2000 | Otsuka et al. | 347/9 |
| 6,142,598 | A | 11/2000 | Iwasaki et al. | 347/9 |
| 6,234,601 | B1 | 5/2001 | Hayashi et al. | 347/16 |
| 6,273,550 | B1 * | 8/2001 | Brown | 347/43 |
| 6,315,387 | B1 | 11/2001 | Horikoshi | |
| 6,426,765 | B1 | 7/2002 | Iwasaki et al. | 347/12 |
| 6,467,896 | B2 * | 10/2002 | Meyer et al. | 347/101 |
| 6,557,964 | B2 | 5/2003 | Kawatoko et al. | 347/15 |
| 6,601,939 | B2 | 8/2003 | Fujita et al. | 347/15 |
| 6,626,517 | B2 | 9/2003 | Iwasaki et al. | 347/40 |

(Continued)

FOREIGN PATENT DOCUMENTS

EP 1 088 669 A2 4/2001

(Continued)

*Primary Examiner*—Julian D Huffman
*Assistant Examiner*—Jason S Uhlenhake
(74) *Attorney, Agent, or Firm*—Fitzpatrick, Cella, Harper & Scinto

(57) ABSTRACT

In an ink jet printing apparatus using many types of inks to execute bidirectional printing, if ejection opening rows for yellow, magenta, and cyan inks are symmetrically arranged, ejection opening rows for a black ink are arranged adjacent to the most inside ejection opening rows for the yellow ink. Thus, a difference in color between forward scanning and backward scanning is determined by a difference in coloring between the black ink and the yellow ink. In this case, a possible color drift attributed to bidirectional printing can be suppressed by selecting the inks so that the difference in coloring between the black ink and the yellow ink is smaller than that between the black ink and the other color inks.

2 Claims, 17 Drawing Sheets

U.S. PATENT DOCUMENTS

| | | | | |
|---|---|---|---|---|
| 6,652,065 | B2 | 11/2003 | Nakagawa | 347/32 |
| 6,682,168 | B2 | 1/2004 | Nakagawa et al. | 347/40 |
| 6,688,716 | B2 | 2/2004 | Kanda et al. | 347/16 |
| 6,719,402 | B2 | 4/2004 | Nakagawa et al. | 347/37 |
| 6,719,403 | B2 | 4/2004 | Kanda et al. | 347/40 |
| 6,729,710 | B2 | 5/2004 | Chikuma et al. | 347/14 |
| 2002/0057308 | A1 | 5/2002 | Iwasaki et al. | 347/41 |
| 2002/0070999 | A1* | 6/2002 | Teshigawara et al. | 347/41 |
| 2002/0101487 | A1* | 8/2002 | Petersen et al. | 347/85 |
| 2002/0105557 | A1* | 8/2002 | Teshigawara et al. | 347/15 |
| 2002/0105559 | A1 | 8/2002 | Nishikori et al. | 347/19 |
| 2002/0109752 | A1* | 8/2002 | Sato | 347/43 |
| 2002/0154182 | A1 | 10/2002 | Takahashi et al. | 347/12 |
| 2002/0167565 | A1 | 11/2002 | Maeda et al. | 347/40 |
| 2003/0179262 | A1* | 9/2003 | Nishikori et al. | 347/43 |
| 2003/0184608 | A1 | 10/2003 | Masuyama et al. | 347/12 |
| 2003/0214555 | A1 | 11/2003 | Teshigawara et al. | 347/43 |
| 2004/0104965 | A1* | 6/2004 | Mitsuzawa | 347/43 |

FOREIGN PATENT DOCUMENTS

| | | | |
|---|---|---|---|
| EP | 1 088 669 | A3 | 8/2002 |
| JP | 58-215352 | A | 12/1983 |
| JP | 11-1647 | | 1/1999 |
| JP | 2000-79681 | A | 3/2000 |
| JP | 2000-318189 | | 11/2000 |
| JP | 2001-96771 | | 4/2001 |

* cited by examiner

INK JET PRINTING APPARATUS

This application claims priority from Japanese Patent Application No. 2003-169969 filed Jun. 13, 2003, which is incorporated hereinto by reference.

BACKGROUND OF THE INVENTION

1. Field of the Invention

The present invention relates to an ink jet printing apparatus, and more specifically, to an ink jet printing apparatus that executes printing by scanning a printing head in two directions.

2. Description of the Related Art

With the recent spread of personal computers, word processors, facsimile machines, and the like to offices and homes, printing apparatuses based on various printing systems have been provided as information output equipment for the above equipment. In particular, printing apparatuses such as printers which are based on an ink jet system can be relatively easily adapted to execute color printing using plural types of inks. The ink jet printing apparatus has various advantages; for example, it makes only a low noise during operation, can achieve high grade printing on a variety of print media, and is small in size. In this respect, the printer based on this system and the like are suitable for personal use at office or home. Of these ink jet system-based printing apparatuses, a serial type in which a printing head reciprocates to perform printing to a printing medium is very popular because it is inexpensive and can print high grade images.

In spite of its relatively low costs, the serial type printing apparatus is desired to exhibit a higher performance. The printing performance is typified by image quality or image grade, and printing speed.

One of factors that determine image quality or the like is the type of ink. In general, the use of more or appropriate types of inks allows a higher-quality image to be printed. The inks can be classified into dye inks, pigment inks, and the like on the basis of coloring materials used for the inks, or dark and light inks on the basis of the concentration of the coloring materials, or a special color such as orange, red, blue inks, and the like on the basis of ink colors.

Well-known printers use, for example, six types of inks including a dye black ink, a dye yellow ink, a dark and light dye magenta inks, and a dark and light dye cyan inks, or four types of inks including a pigment black ink, a dye yellow ink, a dye magenta ink, and a dye cyan ink. The former apparatus focuses on the output to gloss printing media of photographic images of high quality inputted using a digital camera, a scanner, or the like. The latter apparatus focuses on the high-grade output to ordinary paper of black lines such as black letters and charts.

In general, to obtain a high optical reflection density for black, pigment coloring materials such as carbon black are used to perform printing to an ordinary paper rather than using dye color materials as described above. This is because the pigment is dispersed in the ink and because when this ink is applied to the ordinary paper, the dispersion becomes unstable to cause coagulation, resulting in the effective coverage of the surface of the printing medium. Further, when the ink has a surface tension of about 40 dyne/cm, this prevents the ink from bleeding along fibers in the ordinary paper. Such ink designs enable the printing of letters and lines having a high contrast with respect to the surface of the paper as well as sharp edges. On the other hand, the dye dissolves in the ink at a molecular level, whereas the pigment is dispersed in the ink and thus has relatively large coloring material grains.

Thus, the pigment cannot pass through a gloss layer in the surface of a glossy printing medium. The pigment accumulates in the surface of the gloss layer to reduce the glossiness.

Thus, when performing printing to a gloss printing medium, the above printing apparatus using a pigment black ink often expresses a black component of an image by using what is called a process black composed of three color inks, a dye yellow ink, a dye magenta ink, and a dye cyan ink, instead of using a pigment black ink. However, to improve the contrast of a black image in a print, it is more preferable to use a dye black ink than to use the three-color inks. In this case, only the dye black ink is used, thus enabling a reduction in the amount of ink applied per unit area of a printing medium. This prevents problems such as ink bleeding. Further, if a gray level is to be expressed in a print image, dots for a color of a relatively high gray level are generally formed by applying a black ink as well as a cyan, magenta, and yellow inks.

In this manner, combinations of various inks are used depending on the type of images to be printed or printing media used. For example, when ordinary paper is important, the apparatus is configured to use a pigment black ink. If gloss printing media are important, the printing apparatus uses a dye black ink.

In contrast, Japanese Patent Application Laid-open No. 11-001647 (1999) describes a configuration focusing on both ordinary paper and gloss printing media. According to this document, the configuration has printing means for a pigment black ink and printing means for a dye black ink. It does not use the pigment black ink but only the dye black ink to perform printing to printing media that have a gloss layer and an ink receiving layer and that are incompatible with the pigment black ink. It uses the pigment black ink to perform printing to the ordinary paper. In this manner, this configuration can print a high-quality or -grade image on both ordinary paper and gloss print media.

Bidirectional printing is known as a configuration that can improve the printing speed, belonging to the printing performance. With this printing system, in a serial type printing apparatus, the printing head is first scanned in a forward direction for printing. Then, paper is fed by a predetermined amount, and printing scan is subsequently executed again by moving the printing head in a backward direction. This printing system achieves an approximately double printing speed or throughput compared to unidirectional printing in which printing is executed during forward scanning, whereas it is not executed while the printing head is moving in the backward direction. Other known printing systems include what is called one pass printing in which one scan completes printing of a scan area of a width equal to the arrangement width of ejection openings in the printing head, and what is called multi-pass printing in which printing is completed by a plurality of scans between which paper feeding is interposed. The above bidirectional printing system can also achieve the one pass printing and multi-pass printing. If the one pass printing is executed using the bidirectional printing system, the printing speed or throughput can be maximized.

The bidirectional printing system is effective means in improving the printing speed or the like as described above. However, this system is known to vary colors with scan areas, leading to non-uniform colors or color drifts in a printed image. This is because the application order of the color inks differs between the forward and backward directions of the bidirectional printing. In the printing apparatus, ejection opening rows for the respective color inks are commonly arranged in the scanning direction. However, in this case, the application order may be reversed between the forward scanning and the backward scanning depending on the arrangement of the ejection opening rows.

If dots of a predetermined color are to be formed by applying (ejecting) plural types of inks so that these inks are superposed on a pixel, inks applied to a printing medium earlier more favorably develop their colors. This is because the inks applied to the printing medium earlier easily color the material in a layer closer to the front surface of the printing medium, while the inks applied to the printing medium later less easily color the material in the front surface of the printing medium and permeates deeper through the printing medium in its thickness direction before they are settled. This phenomenon is significant if the ink receiving layer is composed of coat paper consisting of silica. However, it also occurs on ordinary paper or gloss printing media having a gloss layer formed in their front surface and an ink receiving layer formed inside the gloss layer.

Japanese Patent Application Laid-open Nos. 2000-318189 (for example, FIG. 6) and 2001-096771 (for example, FIG. 5) describe a configuration that can avoid non-uniform colors or the like attributed to the application order of inks. In this configuration, two nozzle rows are provided for the respective color inks and arranged symmetrically with respect to an axis orthogonal to the scanning direction.

These documents disclose the configuration in which nozzle rows c1 and c2 for a cyan ink, nozzle rows m1 and m2 for a magenta ink, and nozzle rows y1 and y2 for a yellow ink are each arranged symmetrically with respect to a predetermined axis of symmetry orthogonal to the scanning direction of the printing head, for example, as shown in FIG. 16. In this configuration, to form an ink dot for each pixel, the inks are ejected (applied) in order of c1, m1, y1, y2, m2, and c2 in the forward scanning direction. The inks are ejected (applied) in order of c2, m2, y2, y1, m1, and c1 in the backward scanning direction. This enables the inks to be applied or superposed on one another in the same order between the forward scanning and the backward scanning (c←m←y or y←m←c). In other words, the inks are applied in two different orders between the forward scanning and the backward scanning. As a result, for dots formed by superposing the cyan, magenta, and yellow inks on one another, the application or superimposition order remains unchanged regardless of the scanning direction. Alternatively, two types of dots can be formed for each pixel on the basis of the different application orders. These dot formations can reduce the non-uniformity of the colors attributed to the bidirectional printing.

On the other hand, as shown in the same figure, the relationship between nozzle rows k1 and k2 for a black ink and the other ink nozzle rows is such that the inks are ejected in order of k1, k2, c1, m1, y2, m2, and c2. In this case, the superposition order of the black ink and the other inks varies depending on the scanning direction. If image data to be printed forms dots using only the black ink, the superposition of this ink on the other inks described above does not occur. However, for example, in expressing a gray tone, the black ink may be superposed on another color ink such as cyan to form dots in order to smooth a variation in gray level. In this case, the application or superimposition order of the black ink and the other color inks may vary depending on the scanning direction. This may result in non-uniform colors.

This will be described in further detail in connection with under color removal commonly executed as image processing for generation of the above data.

FIG. 17 illustrates an example of an under-color removal process. This figure indicates the relationship between the gray level and the respective output levels of process black obtained using a cyan ink, a magenta ink, and a yellow ink and of black obtained using a black ink. In the illustrated under-color removal process, when the gray level is relatively low (0 to 187), only the cyan ink, magenta ink, and yellow ink are outputted so as to form an image using the process black. Then, the black ink starts to be used at a predetermined medium density (187) in the gray level. At the maximum density level, the data is outputted so as to use only the black ink.

The process black ink is used when the gray level is relatively low because the cyan ink, the magenta ink, and the yellow ink are lighter and give a less significant granular impression than the black ink, thus enabling a smooth gray level expression. Both process black ink and black ink are used when the density is higher than the medium density (187 or more) because the formation of a black image using the black ink requires less inks to be applied to a printing medium than the printing of a black image using the process black ink, thus preventing problems such as the overflow of the inks during printing. Furthermore, the use of the black ink enables the printing of a black image with a higher optical reflection density and a higher contrast.

Thus, when the gray level is between the medium density and the maximum density, the black ink and the process black ink are superposed on each other. The conventional printing head configuration shown in FIG. 16 can of course form such dots. In this case, the process black ink and the black ink are unlikely to be superposed on each other close to the medium and maximum densities. Consequently, the varying ink application order attributed to the bidirectional printing is unlikely to cause non-uniform colors.

However, between the medium density level, at which the black starts to be used, and the vicinity of the maximum density level, at which only the black ink is used, there exists an area in which dots are formed with the cyan ink, magenta ink, and yellow ink, constituting the process black, and the black ink being superposed. In an image of a density level within this area, the non-uniformity of the colors may be significant which is attributed to the application order varying depending on the scanning direction.

The inventors of the present invention have found out that a dot formed by superposing one, two, or all of the cyan ink, magenta ink, and yellow ink and the black ink is differently colored depending on an overlapping manner, that is, the order of superposing the black ink in relation to the other color inks, or to which color ink the black ink is superposed to be adjacent. Specifically, in the conventional arrangement of the ejection openings for the black ink and other color inks such as the one shown in FIG. 16, the overlapping manner may vary markedly between the forward and backward directions of the bidirectional printing. Consequently, a dot formed by superposing the black ink and the other color inks may be differently colored between the forward direction and the backward direction. This results in non-uniform colors.

A configuration has been proposed in which like the nozzle rows for the cyan, magenta, and yellow inks, the nozzle rows for the black ink are symmetrically arranged in order of, for example, k1, c1, m1, y1, y2, m2, c2, and k2. However, in this case, supply liquid chambers must be provided to supply the nozzle rows k1 and k2 with the corresponding inks. This increases the size of the printing head. In contrast, with two adjacent nozzle rows, only one ink supply liquid chamber is required, suppressing an increase in size.

SUMMARY OF THE INVENTION

It is an object of the present invention to provide an ink jet printing apparatus configured to execute bidirectional printing using many types of inks and which achieves high-grade printing by reducing the non-uniformity of the colors attributed to the bidirectional printing, while preventing an increase in the size of a printing head.

In the first aspect of the present invention, there is provided an ink jet printing apparatus that uses a printing head and scans the printing head over a printing medium in forward and backward directions so that during each of a forward scan and a backward scan of the printing head, dots are formed by superposing a plurality types of ink ejected from ejection openings of the printing head so as to perform printing to the printing medium, wherein the printing head arranges the ejection openings for the plurality types of ink in the forward and backward scan directions, the ejection openings for the plurality types of ink include symmetrically arranged ejection openings in the arrangement of the ejection openings and an ejection opening located between predetermined two ejection openings of different types of ink among the symmetrically arranged ejection openings, and the type of ink ejected from the ejection opening between predetermined two ejection openings of different types of ink is black ink.

In the second aspect of the present invention, there is provided an ink jet printing apparatus that uses a printing head and performs forward and backward scans of the printing head over a printing medium in a main scan direction so that during each of a forward scan and a backward scan of the printing head, dots are formed by superposing a plurality types of ink ejected from ejection openings of the printing head so as to perform printing to the printing medium, wherein the printing head has a group of ejection opening rows that arrange the ejection openings respectively corresponding to the plurality types of ink along the main scan direction, each of the ejection opening rows arranging a plurality of ejection openings along a direction different from the main scan direction, a plurality of ejection opening rows in the group of ejection opening rows, except ejection opening row of at least one type of ink, are symmetrically arranged along the main scan direction, and the at least one type of ink includes black ink.

With the above configuration, the ejection openings of the printing head are arranged so that between ejection openings for two predetermined different inks included in the predetermined symmetrically arranged ejection openings for which the manner of overlapping can be controlled to remain unchanged between the forward scanning and the backward scanning, an ejection opening except the predetermined symmetrical ejection openings is located. This reduces the difference in the color of a dot formed when the manner of superposing the ink ejected from the ejection opening except the predetermined symmetrical ejection openings and the inks ejected from the predetermined symmetrically arranged ejection openings varies between the forward scanning and the backward scanning.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Embodiments of the present invention will be described below with reference to the drawings.

First Embodiment

For an ink jet printing apparatus according to a first embodiment of the present invention, a detailed description will be given of inks used, the configuration of a printing head, the configuration of a printer, and the like.

Inks

First, description will be given of inks used in an ink jet printer operating as the ink jet printing apparatus according to the first embodiment of the present invention.

In the present embodiment, two types of inks are used as a black ink in accordance with a print mode as described later. A first black ink is obtained by using a pigment composed of carbon black as a coloring material. The surface of the pigment is treated using a carboxyl group so as to be dispersed in the ink. Further, to inhibit the evaporation of moisture from the ink, it is preferable to add polyalcohol such as glycerin as a humectant. Moreover, since the pigment ink is used to print characters, it is important to prevent the degradation of the edge of black ink dots formed on ordinary paper. However, an acetylene glycol-based surfactant may be added to adjust the permeability of the ink to the extent that the edge is not degraded. Further, polymer may be added as a binder to improve the binding capacity between the pigment and a printing medium.

On the other hand, a second black ink uses a black dye as a coloring material. Further, a critical micelle concentration or higher of acetylene glycol-based surfactant is added to allow the ink to permeate through the front surface of the printing medium at a sufficiently high speed. Also for this ink, it is preferable to add polyalcohol such as glycerin as a humectant to inhibit the evaporation of moisture from the ink. Additionally, urea maybe added to improve the solubility of the color material.

In the present embodiment, the color inks include a cyan ink, a magenta ink, and a yellow ink. These inks are composed of a cyan, magenta, and yellow dyes, respectively. It is preferable to add a humectant, a surfactant, and an additive similar to those for the second black ink to these inks.

Further, the surfactant is desirably adjusted so that the second black ink, the cyan ink, the magenta ink, and the yellow ink have approximately the same surface tension. By setting uniform permeability for ordinary paper, it is possible to inhibit the bleeding between areas on a sheet which are printed using different inks. Other characteristics such as the permeability and viscosity of the ink can be equally adjusted for the second black ink, cyan ink, magenta ink, and yellow ink.

Configuration of Printing Head

Now, with reference to FIGS. 1 and 2, description will be given of the configuration of a printing head according to the present embodiment.

Figure 1:
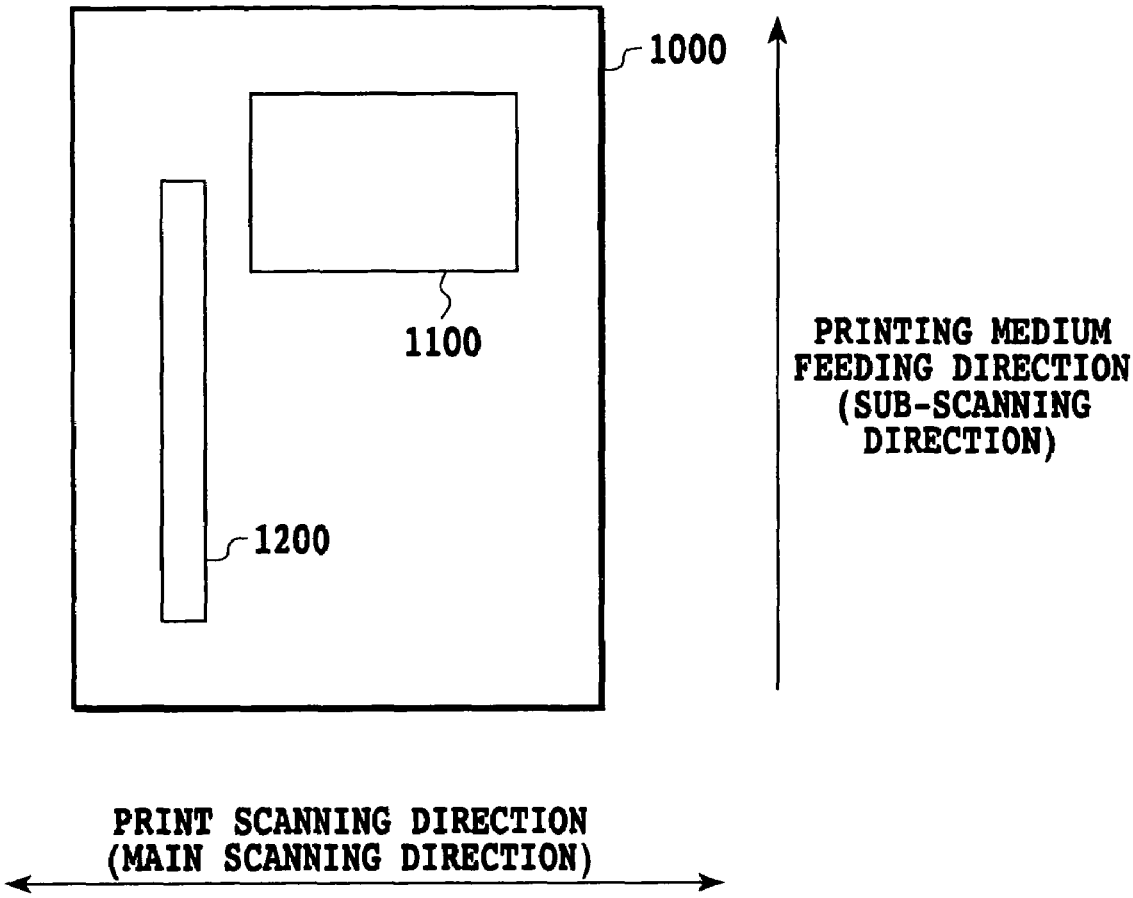
FIG. 1 is a schematic diagram illustrating the chip configuration of a printing head used in an embodiment of the present invention.

FIG. 1 is a schematic diagram of the printing head installed in the present printer as viewed from a printing medium; it shows the arrangement of each print chip.

As shown in this figure, the printing head according to the present embodiment is formed by attaching a color ink chip 1100 and a black ink chip 1200 on a substrate 1000. The black ink chip 1200 is composed of ejection openings (also referred to nozzles in the specification) through which the first black ink is ejected. This chip is longer than the color ink chip 1100 in the direction in which print media are conveyed (sub-scanning direction), that is, the ejection openings in this chip are arranged over a longer distance than those in the color ink chip 1100. Furthermore, the ejection opening row on this chip positionally deviate from the ejection opening row for each ink in the color ink chip by a predetermined amount in the sub-scanning direction. As illustrated in FIG. 1, on the downstream side in the conveying direction, the ends of the ejection opening rows arranged in the color ink chip 1100 are located more downstream of the end of the ejection opening row arranged in the black ink chip 1200. This is because the focus is placed on the printing speed accomplished if a document or the like is printed using the black ink chip. That is, a width in the sub-scanning direction which can be printed during one scan of the chip using the ejection row arranged in the black ink chip 1200 in the sub-scanning direction is larger than the corresponding width that can be printed using the ejection rows arranged in the color ink chip 1100. Furthermore, the color ink chip 1100 and the black ink chip 1200 positionally deviate from each other in the printing medium conveying direction so as to enable the pigment black ink to be applied, before the color inks, to the same printing area on the printing medium. This configuration creates a time difference between the ejection of the pigment black ink from the black ink chip 1200 and the printing using the color ink chip 1100. This in turn suppresses the possible ink bleeding between an image printed using the pigment black ink and an image printed using the dye color ink.

Figure 2:
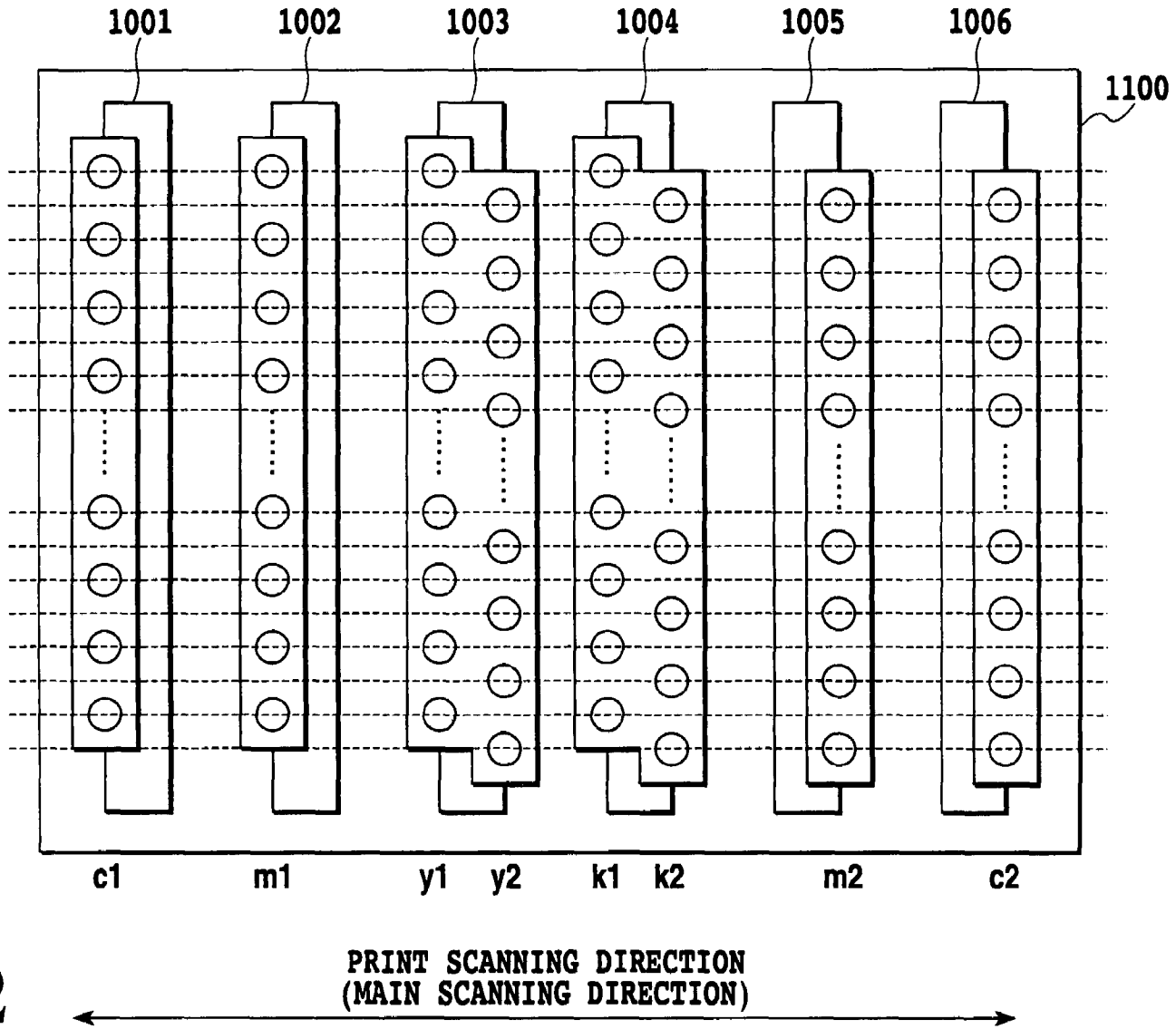
FIG. 2 is a diagram showing the arrangement of ejection opening rows in a color ink chip of a printing head used in a first embodiment of the present invention.

FIG. 2 is a schematic diagram showing the arrangement of the ejection openings for the respective colors in the color ink chip 1100.

The color ink print chip according to the present embodiment is provided with a plurality of openings for the cyan, magenta, yellow, and second black inks, and heaters that correspond to the respective ejection openings and that generate thermal energy utilized for ejection. Two ejection opening rows are provided for each color ink. The ejection opening rows are symmetrically arranged for the cyan, magenta, and yellow inks as previously described. However, such an arrangement is not used for the second black ink; ejection opening rows k1 and k2 are arranged between the ejection opening row y2 for the yellow ink and the ejection opening row m2 for the magenta ink. As described later in FIGS. 10 and 11, this arrangement prevents the order of application of the second black ink and the other color inks or the manner of overlapping of these inks on one another from varying markedly between the forward direction and the backward direction.

The specific configuration of the color ink chip is such that six grooves are formed in the same chip 1100, made of silicon, and that each of the grooves is formed with the above ejection openings for the corresponding ink. That is, the following are formed: the ejection openings, ink channels in communication with the ejection openings, heaters each formed in a part of the corresponding ink channel, and a supply channel common to these ink channels.

Further, driving circuits (not shown) are provided between the grooves in the chip 1100 to drive the heaters. The heaters and driving circuits are manufactured during a process of forming a semiconductor film. Furthermore, the ink channels and the ejection openings are formed of resin. Moreover, ink supply channels are formed in the back surface of the silicon chip to supply the ink to the respective grooves.

The six grooves, a first groove 1001, a second groove 1002, a third groove 1003, a fourth groove 1004, a fifth groove 1005, and a sixth groove 1006 are sequentially arranged in the scanning direction so that the first groove 1001 is closest to the left end of the figure. Then, in the present embodiment, the cyan ink is supplied to the first groove 1001 and sixth groove 1006. The magenta ink is supplied to the second groove 1002 and fifth groove 1005. The yellow ink is supplied to the third groove 1003. The second black ink, made using a dye as a color material, is supplied to the fourth groove 1004.

The nozzle row c1 for the cyan ink, composed of 64n (n is an integer equal to or larger than 1; for example, n=4) ejection openings, is formed in the first groove 1001. The nozzle row m1 for the magenta ink, composed of 64n ejection openings, is formed in the second groove 1002. The nozzle row y1 for the yellow ink, composed of 64n ejection openings, is formed in the side of the third groove 1003 closer to the second groove. The nozzle row y2 for the yellow ink, composed of 64n ejection openings, is formed in the side of the third groove 1003 closer to the fourth groove. The nozzle row m2 for the magenta ink, composed of 64n ejection openings, is formed in the fifth groove 1005. The nozzle row c2 for the cyan ink, composed of 64n ejection openings, is formed in the sixth groove 1006. The nozzle row k1 for the dye black ink (second black ink), composed of 64n ejection openings, is formed in the side of the fourth groove 1004 closer to the third groove. The nozzle row k2 for the same dye black ink, composed of 64n ejection openings, is formed adjacent to the nozzle row k1 in the fourth groove 1004.

The ejection openings are arranged in each nozzle row at an approximately equal pitch. The nozzle rows for the same color ink are positionally deviate from each other by half an ejection opening arrangement pitch in the sub-scanning direction. This is to obtain the maximum efficiency of coverage of print media with print dots for each pixel during one printing scan.

In the present embodiment, the combination of the cyan magenta, and yellow inks is referred to as a first ink combination. The combination of the cyan, magenta, yellow, and second black inks is referred to as a second ink combination. As is apparent from the symmetric arrangement shown in FIG. 2, if a secondary or tertiary color is expressed using arbitrary two or more types of inks from the first ink combination, two application orders are available.

Figure 3:
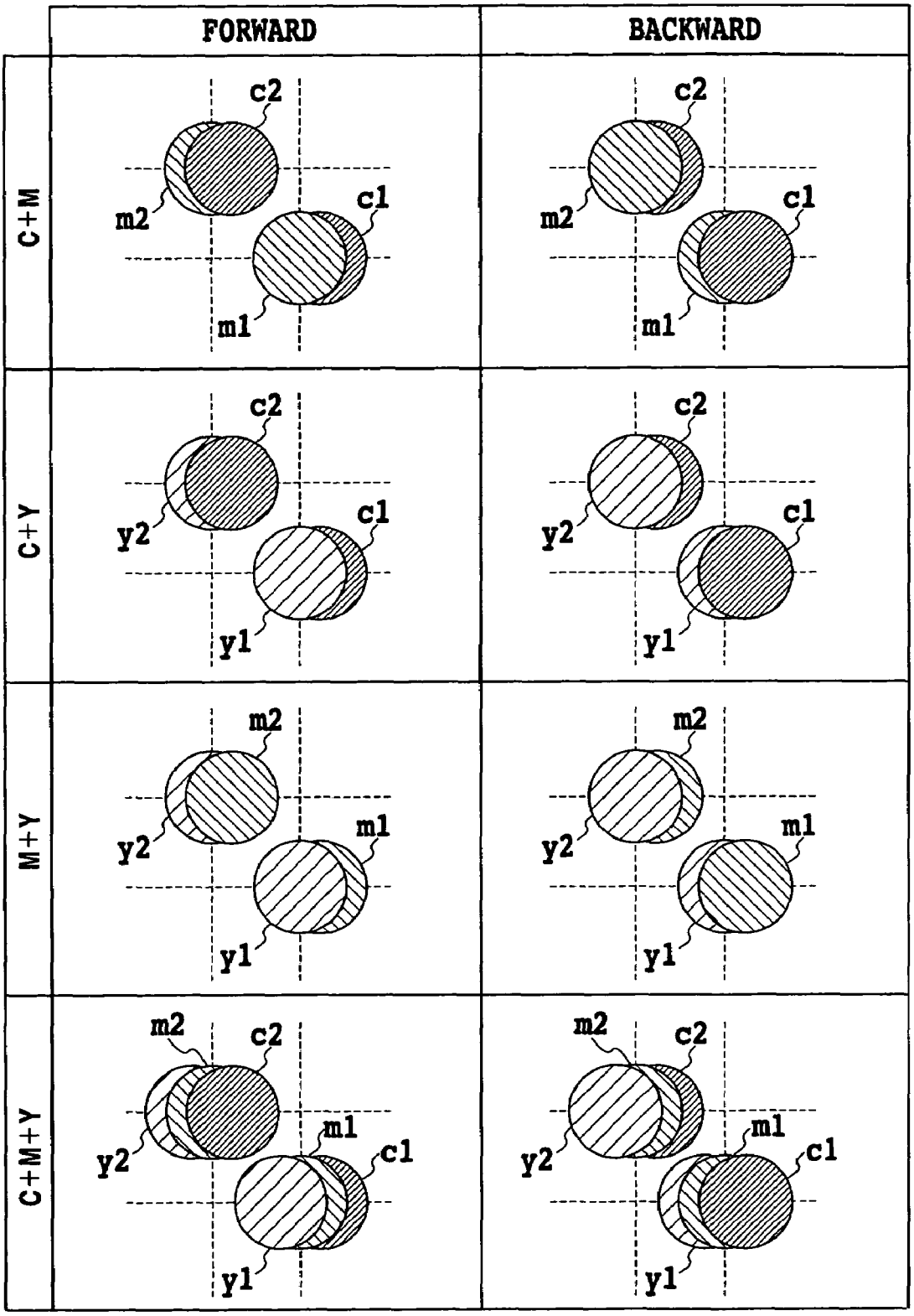
FIG. 3 is a diagram illustrating the relationship between combinations of a plurality of inks and their application order and a scanning direction of the printing head.

With reference to FIG. 3, a specific description will be given of the order of application inks from the first ink combination. In FIG. 3, vertical lines represent cyan dots (dots formed of the cyan ink; this applies to the other types of dots), horizontal lines represent magenta dots, and lattice lines represent yellow dots. Further, in this figure, the dots are shifted from each other to make the reader understand the actual order of superimposition.

As is apparent from FIG. 3, for blue (C+M), which is a secondary color obtained by combining the cyan ink and the magenta ink together, two types of pixels, pixels for which the magenta ink is applied after the cyan ink and pixels for which the cyan ink is applied after the magenta ink, can be printed during the forward and backward scanning, respectively, using the set of the nozzle rows c1 and m1 and the set of the nozzle rows c2 and m2. The print data can be processed so that almost the same number of pixels are generated during the forward scanning and during the backward scanning. This can be accomplished using either one pass printing or multipass printing. As described above, in the present embodiment, instead of using the same order of application for all the pixels in the bidirectional printing, two types of application orders or dot superimposition manners are used. Further, the print data is processed so that almost the same number of pixels are generated for these two types. This makes the non-uniformity of the colors more insignificant which is attributed to the different application orders.

Likewise, for green (C+Y), which is a secondary color obtained by combining the cyan ink and the yellow ink together, two types of pixels, pixels for which the yellow ink is applied after the cyan ink and pixels for which the cyan ink is applied after the yellow ink, can be generated using the set of the nozzle rows c1 and y1 and the set of the nozzle rows c2 and y2. For red (M+Y), which is a secondary color obtained by combining the magenta ink and the yellow ink together, two types of pixels, pixels for which the yellow ink is applied after the magenta ink and pixels for which the magenta ink is applied after the yellow ink, can be generated using the set of the nozzle rows m1 and y1 and the set of the nozzle rows m2 and y2. Furthermore, for a tertiary color obtained using the cyan, magenta, and yellow inks, two types of pixels, pixels using the application order of cyan, magenta, and yellow and pixels using the application order of yellow, magenta, and cyan, can be generated using the set the nozzle rows c1, m1, and y1 and the set of nozzle rows c2, m2, and y2.

For the second black ink, similar two types of superimposition manners are possible for cyan and magenta. However, since the cyan and yellow nozzle rows are not symmetrically arranged, the application orders in the two types of superimposition manners are not completely opposite to each other as shown in FIG. 3. The embodiment of the present invention utilizes this to prevent an increase in the difference between the two types of superimposition manners as described later in FIGS. 10 and 11.

Configuration of Printer

Figure 4:
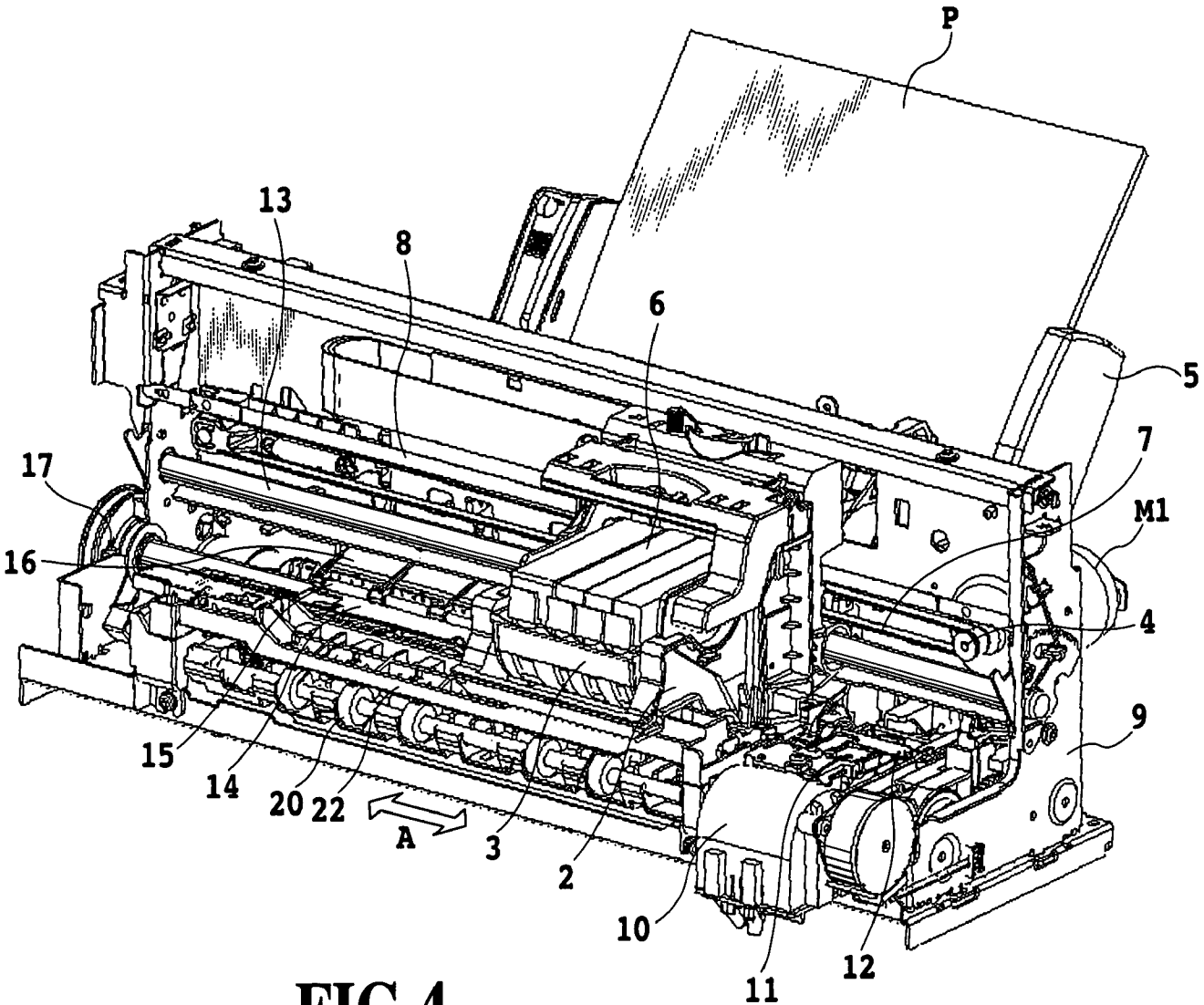
FIG. 4 is a perspective view showing the configuration of an ink jet printer according to an embodiment of the present invention.

FIG. 4 is a diagram showing the configuration of the ink jet printer according to the present embodiment. FIG. 4 is a perspective view showing the ink jet printer from which a case cover has been removed.

As shown in FIG. 4, the ink jet printer according to the present embodiment comprises a carriage 2 on which the printing head 3, described in FIG. 1, is detachably mounted, and a driving mechanism that moves the carriage 2 to scan the printing head. Specifically, the carriage 2 can be reciprocated in the direction of an arrow A in FIG. 4 by transmitting the driving force of a carriage motor M1 operating as a driving source, to the carriage 2 via a transmission mechanism such as a pulley. Ink cartridges 6 are detachably mounted on the carriage 2 in association with the types of inks used in the present printer. As described in FIGS. 1 and 2, the present embodiment uses the five types of inks including the first and second black inks, the cyan ink, the magenta ink, and the yellow ink. However, FIG. 4 is a simplified view showing only four ink cartridges.

The carriage 2 is formed with ink supply channels through which the inks from the corresponding cartridges are supplied to the grooves in the black ink chip 1200 and color ink chip 1100, show in FIGS. 1 and 2. The printing head 3, composed of the carriage 2 and the above described chips, are configured so that junction surfaces of both members can be properly contacted with each other for electric connections. Thus, in response to a print signal, the printing head 3 applies a voltage pulse to the previously described heaters to generate bubbles in the ink. Consequently, the pressure of the bubbles enables the ink to be ejected from the ejection openings. Specifically, a pulse is applied to the heaters, electrothermal converters, which then generate thermal energy. Thus, film boiling occurs in the ink to grow and contract bubbles to vary the pressure on the ink. As a result, the ink is ejected from the ejection openings.

The printer also comprises a paper feeding mechanism that conveys (feeds) print paper P that is a printing medium. The paper feeding mechanism feeds paper by a predetermined amount in accordance with the scanning of the printing head. Moreover, a recovery device 10 is provided at one end of the movement range of the carriage 2 to execute an ejection recovery process for the printing head 3.

In this ink jet printer, the paper feeding mechanism 5 feeds the print paper P into a scanning area of the printing head 3. The printing head 3 is scanned to print images, characters, or the like on the print paper P.

The configuration of this apparatus will be described in further detail. The carriage 2 is connected to a part of a driving belt 7 constituting a transmission mechanism 4 that transmits the driving force of the carriage motor M1. The carriage 2 is guided and supported so as to slide along a guide shaft 13 in the direction of the arrow A. This allows the driving force of the carriage motor M1 to be transmitted to the carriage 2 to move it. In this case, the carriage 2 can be moved forward or backward by rotating the carriage motor M1 forward or backward, respectively. In FIG. 4, reference numeral 8 denotes a scale used to detect the position of the carriage 2 in the direction of the arrow A. In the present embodiment, the scale is composed of a transparent PET film on which black bars are printed at a predetermined pitch. One end of the scale is secured to a chassis 9, while the other end is supported by a plate spring (not shown). A sensor provided on the carriage 2 can optically detect the bars on the scale to detect the position of the carriage 2.

In the scanning area of the printing head 3, platens (not shown) are provided in respective areas that lie opposite the corresponding ejection opening rows during the scanning of the printing head 3. The appropriate ink is ejected to the print paper P being conveyed on the platen to print the print paper 8 the flat surface of which is maintained by the platen.

Reference numeral 14 denotes a conveying roller driven by a conveying motor M2 (not shown). Reference numeral 15 denotes a pinch roller that abuts the print sheet against the conveying roller 14 using a spring (not shown). Reference numeral 16 denotes a pinch roller holder that rotatably supports the pinch roller 15. Reference numeral 17 denotes a conveying roller gear attached to one end of the conveying roller 14. The conveying roller 14 is driven by transmitting rotation of the conveying motor M2 to the conveying roller gear 17 via an intermediate gear (not shown). Reference numeral 20 denotes a discharge roller that discharges the print paper on which an image has been formed by the printing head 3, out of the apparatus. The discharge roller 20 is similarly driven by transmitting rotation of the conveying motor M2 to the roller 20. On the discharge roller 20, a spur roller (not shown) is abutted against the print paper by the pressure of a spring (not shown). Reference numeral 22 denotes a spur holder that rotatably supports the spur roller.

As described above, the recovery device 10 is provided at a predetermined position (for example, a position corresponding to a home position) outside the range (scanning range) of reciprocation of the carriage 2 for a printing operation. The recovery device 10 maintains the ejection performance of the printing head 3. The recovery device 10 comprises a capping mechanism 11 that caps an ejection opening surface of the printing head 3 and a wiping mechanism 12 that cleans the ejection opening surface (the surface provided with the ejection opening rows for the respective colors) of the printing head 3. An ejection recovery process can be executed by, for example, using a suction mechanism (a suction pump or the like; not shown) in the recovery device to force the ink to be discharged from the ejection openings in unison with the capping of the ejection openings by the capping mechanism 11, thus removing more viscous ink, bubbles, and the like from the ink channels in the printing head 3. Further, by capping the ejection opening surface of the printing head 3 during non-printing or the like, it is possible to protect the printing head, while preventing the ink from being dried. The wiping mechanism 12 is disposed close to the capping mechanism 11 to clean the printing head 3 by wiping off ink droplets attached to the ejection opening surface of the printing head 3. The capping mechanism 11 and the wiping mechanism 12 enable the printing head 3 to maintain normal ejections.

Figure 5:
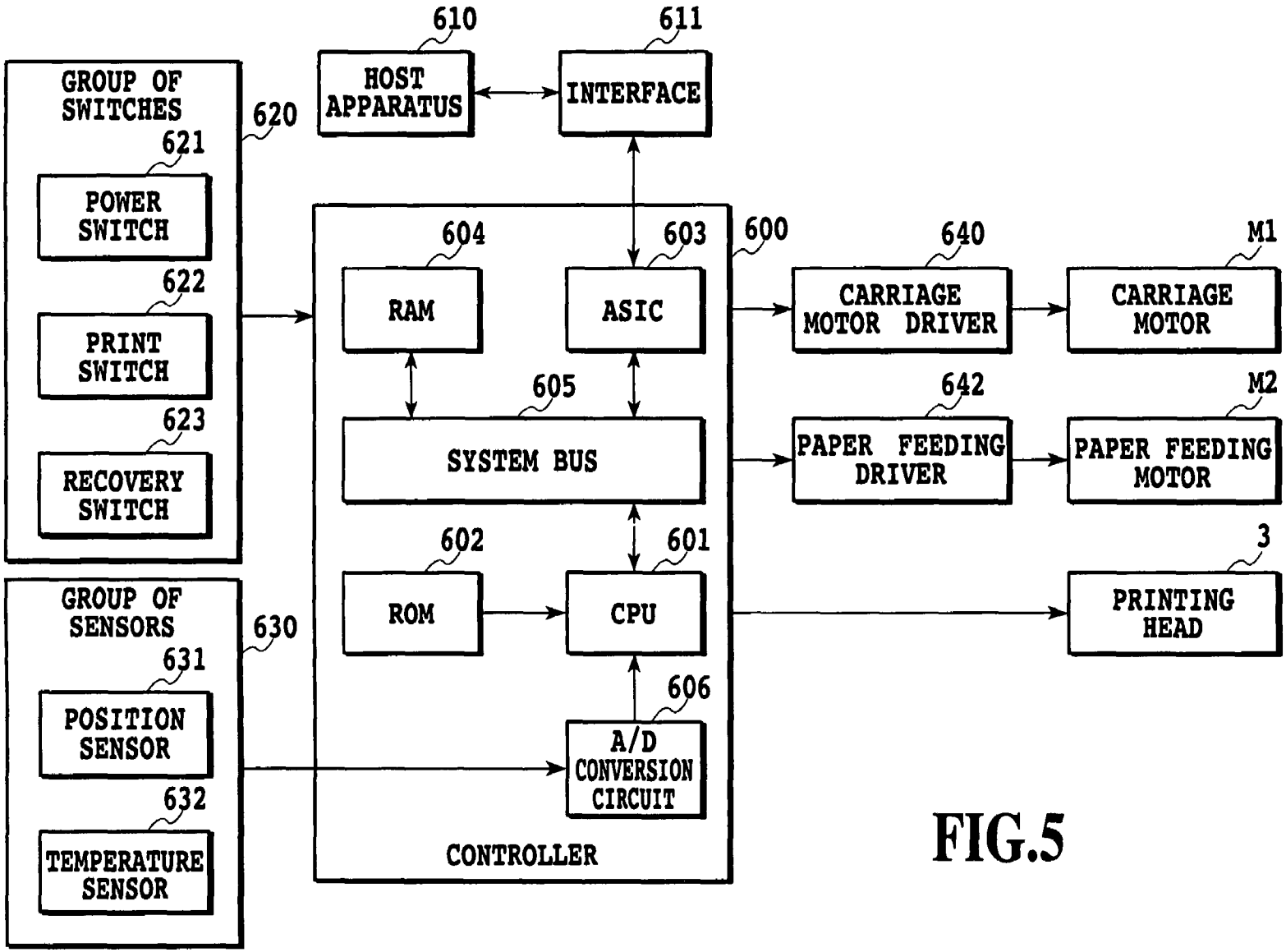
FIG. 5 is a block diagram schematically showing the configuration of a control system in the ink jet printer shown in FIG. 2.

FIG. 5 is a block diagram schematically showing the configuration of a control system in the ink jet printer configured as shown in FIG. 4.

As shown in FIG. 5, a controller 600 is composed of, for example, a CPU 601 in a microcomputer form, a ROM 602 that stores programs corresponding to the execution of various print modes described later, the control of printing operations in the respective print modes, and a sequence of image processing described later, required tables, and other fixed data, an application-specific integrated circuit (ASIC) 603 that generates control signals for the control of the carriage motor M1 and paper feeding motor M2 and the control of ejections from the printing head 3, during the execution of each print mode, a RAM provided with areas in which image data is expanded, work areas, and the like, a system bus 605 that connects the CPU 601, the ASIC 603, and the RAM 604 together to transmit data, and an A/D converter 606 which receives analog signals from a group of sensors described later to subject these signals to A/D conversions and which then supplies the digital signals to the CPU 601.

Reference numeral 610 denotes a host computer (or an image reader or a digital camera) operating as a source of image data. The host computer transmits and receives image data, commands, status signals, and the like to and from the controller 600 via an interface (I/F) 611.

Reference numeral 620 denotes a group of switches that accepts instruction inputs from an operator; the switches include a power switch 621, a switch 622 that instructs on the start of printing, and a recovery switch 623 that instructs on the activation of a recovery process for the printing head 3. Reference numeral 630 denotes the group of sensors, composed of, for example, a photo coupler 631 combined with the scale 8 to detect that the printing head 3 has been moved to its home position h and a temperature sensor 632 provided at an appropriate position in the printer to detect an environmental temperature. Moreover, reference numeral 640 denotes a driver that drives the carriage motor M1. Reference numeral 642 denotes a driver that drives the paper feeding motor M2.

With the above configuration, the printer according to the present embodiment analyzes a command for print data transferred via the interface 611 and expands image data to be printed into the RAM 602. The area (expansion buffer) into which the image data is expanded has a horizontal size of the number Hp of pixels corresponding to a printable area in the main scanning direction and a vertical size of 64n (n is an integer equal to or larger than 1; for example, n=4), the number of pixels in the vertical direction which are printed during one scan using the nozzle rows in the printing head. The expansion buffer is provided on a storage area of the RAM 602. A storage area (print buffer) on the RAM 602 which is referenced in order to send data to the printing head during print scanning has a horizontal size of the number Vp of pixels corresponding to the printable area in the main scanning direction and a vertical size of 64n, the number of pixels in the vertical direction which are printed during one print scan of the printing head. The print buffer is provided on the storage area of the RAM 602.

When the printing head executes print scanning, the ASIC 603 acquires data on the driving of the heater for each ejection opening in the printing head while directly accessing the storage area (print buffer) of the RAM 620. The ASIC 603 transfers the data acquired to the printing head 3 (to the driver for the printing head 3).

Data Processing

In the present embodiment, multi-valued data for red (R), green (G), and blue (B) is subjected to predetermined image processing and thus converted into binary or three-valued data into which cyan, magenta, yellow, and black, the ink colors used in the present printer, are quantized. In the present embodiment, this process is executed by the host apparatus 610 but may be executed by a controller for the printer or the like.

The data processing according to the present embodiment is executed depending on a print mode described later. Specifically, print data is converted into binary or three-valued data depending on the print mode. In a print mode with a high printing speed, the print data is converted into binary data. In a print mode for a higher-quality image, the print data is converted into three-valued data. In the above data processing and printing operation, the unit or size of a pixel for processing corresponds to each ink dot that can be formed using two ejection openings (ejection openings in different ejection opening rows) in two ejection opening rows for the same ink color which openings are adjacent to each other in the sub-scanning direction with a spacing corresponding to half the ejection opening arrangement pitch of each ejection opening row. Such pixels cause dots to be formed at separate positions. More specifically, the unit of a pixel corresponds to an area having two dots formed at a lattice point.

Moreover, for bidirectional printing, the data processing distributes data in association with the two ejection opening rows for each color ink. Specifically, a print buffer is provided for each ejection opening row, and the binary or three-valued data is stored in the corresponding print buffer. Then, for each scan, data is read from the print buffer corresponding to each ejection opening row and transferred so as to eject the ink from the ejection opening in the ejection opening row.

(Binary Data)

If the data into which cyan, magenta, and yellow are quantized is binary, the same print buffer is used for the pair of two ejection opening rows (nozzle rows) for the same ink color.

Specifically, the same cyan first print buffer is assigned to the cyan nozzle row c1 and cyan nozzle row c2. Likewise, a magenta first print buffer is assigned to the magenta nozzle row m1 and magenta nozzle row m2. A yellow first print buffer is assigned to the yellow nozzle row y1 and yellow nozzle row y2. That is, in the case of, for example, cyan ink, all the binarized data is expanded into the cyan first print buffer. Then, during a forward scan, the binary data expanded into the cyan first print buffer is referenced and transferred in association with both cyan nozzle row c1 and cyan nozzle row c2 in the printing head. Thus, the ink is ejected from the corresponding ejection openings. Similarly, during a backward scan, the binary data expanded into the cyan first print buffer is referenced and transferred in association with both cyan nozzle row c1 and cyan nozzle row c2 in the printing head. Thus, the ink is ejected from the corresponding ejection openings. In this manner, in the present embodiment, the cyan nozzle row c1 and the cyan nozzle row c2 print the same image on a printing medium. That is, a pixel with binary data of 1 is composed of two dots formed using the ink ejected from the ejection openings in the different ejection opening rows for the same ink color. Similarly, for magenta or yellow, the magenta first print buffer or the yellow first print buffer, respectively, is referenced to print an image using two ejection opening rows.

In this case, the two dots constituting each pixel (with binary data of 1) are obtained from the different nozzle rows. Accordingly, as shown in FIG. 3, even for a secondary or tertiary color, two types of ink application orders are present. Therefore, for the entire print image, a number of dots are formed using one of the ink application orders, while the same number of dots are formed using the other ink application order. Thus, the difference in color ink application order or superimposition manner resulting from the difference in scanning direction is reduced both for each pixel and for the entire print image. It is thus possible to reduce the possibility that nonuniform colors occur.

As described later, the first black ink, a pigment ink, may be used depending on the print mode. The corresponding binary data is stored in one print buffer as in the case of normal printing. Further, for printing, the data is referenced and transferred in association with each ejection opening in the black ink chip 1200. This also applies to three-valued data.

(Three-Valued Data)

If the data into which cyan, magenta, and yellow are quantized has three values, dots are formed at three levels: no dots, 1 dot, and 2 dots. Correspondingly, the contents of the three-valued data are 0, 1, and 2; three-valued data of 0 corresponds to no data, three-valued data of 1 corresponds to 1 dot, and three-valued data of 2 corresponds to 2 dots.

In this case, the storage area is divided into a first print buffer and a second print buffer in association with the nozzle rows for each ink color for management. Specifically, the cyan first print buffer is assigned to the cyan nozzle row c1. The magenta first print buffer is assigned to the magenta nozzle row m1. The yellow first print buffer is assigned to the yellow nozzle row y1. The yellow second print buffer is assigned to the yellow nozzle row y2. The magenta second print buffer is assigned to the magenta nozzle row m2. The cyan second print buffer is assigned to the cyan nozzle row c2.

If the quantized three-valued data is 0, 0 indicating no data is expanded into both first and second print buffers. If the quantized three-valued data is 2, 1 indicating 1 dot data is expanded into both first and second print buffers. Thus, if the three-valued data for an ink color is 2, two dots from the different nozzle rows are formed for each pixel with three-valued data of 2 during either a forward or backward scan. If the quantized three-valued data is 1, 1 is expanded into one of the first and second print buffers, with 0 expanded into the other. In this case, every time the three-valued data has a value of 1 for the same ink color, data is stored indicating into which print buffer 1 has been expanded. Then, next time the three-valued data has a value of 1, the data expansion is controlled so as to switch the print buffer into which the data is expanded. Thus during either a forward or backward scan, one dot is formed for a pixel with three-valued data of 1 using one of the different nozzle rows.

As a result of the distribution of three-valued data, each of the different nozzle rows is used to print the same number of dots when a large number of pixels are viewed in a macro manner. Accordingly, there are a number of dots formed with one of the two application orders as well as the same number of dots formed with the other application order. Consequently, the non-uniformity of the colors is relatively difficult to recognize.

As described above, the data processing executed if the quantized data is binary is suitable for the high-speed print mode because it involved a smaller amount of data to be processed than the data processing for three-valued data. Further, for the data processing for binary data, since two dots are formed for each pixel in the present embodiment, the resultant image has a lower grade in terms of a granular impression than one obtained through the processing for three-valued data, which uses 1 dot for a lower density portion of the print image. Accordingly, three-valued data is used in the high-quality print mode. In this connection, yellow, which is unlikely to be degraded in terms of the granular impression, may be subjected to binary quantization, while the other colors maybe subjected to three-valued quantization.

Even if the gray level is expressed using four or more values, the same correspondences between the ejection opening rows and the print buffers as those for the distribution of three-valued data are used. As in the case of three-valued data, if an even number of dots are used for the expression, the data is expanded so that the same number of dots are printed in each of the first and second print buffers. If an odd number of dots are used for the expression, the data is expanded so that the number of dots printed in one of the first and second print buffers is one dot larger than that printed in the other print buffer. Then, every time the number of dots for the gray level expression for the same ink color is odd, data is stored indicating into which print buffer one-dot-larger data has been expanded. Next time the number of dots for a pixel is odd, the data is expanded so as to switch the print buffer into which one-dot-larger data is expanded.

For the black ink (second black ink), as shown in FIG. 2, the two ejection opening rows are not symmetrically arranged in contrast to the cyan, magenta, and yellow inks. The black print buffers and the distribution of quantized data are similar to those for cyan, magenta, and yellow, described above.

Specifically, if the quantized data is binary, the two nozzle rows share the same print buffer. If the quantized data has three values, the storage area is divided into the first and second print buffers in association with each nozzle row for management. That is, for management, the black first print buffer is assigned to the black nozzle row k1, whereas the black second print buffer is assigned to the black nozzle row k2. The three-valued data is distributed in the same manner as that used for the distribution of three-valued data for cyan, magenta, and yellow.

However, in contrast to cyan, magenta, and yellow, the ejection opening rows k1 and k2 for the second black ink are not symmetrically arranged as shown in FIG. 2. Accordingly, the order of application or superimposition of the second black ink and the other color inks such as the cyan ink varies between the forward scanning and the backward scanning. Further, it is impossible that the number of dots formed with one of the two application orders is the same as that formed with the other application order. Thus, as described later in FIGS. 10 and 11, the difference between the two superimposition manners is suppressed.

One-Pass Printing

In the present embodiment, as described later in connection with the print mode, bidirectional printing is executed for one pass or multiple passes depending on the print mode. First, description will be given of one-pass printing according to the present embodiment.

Figure 6:
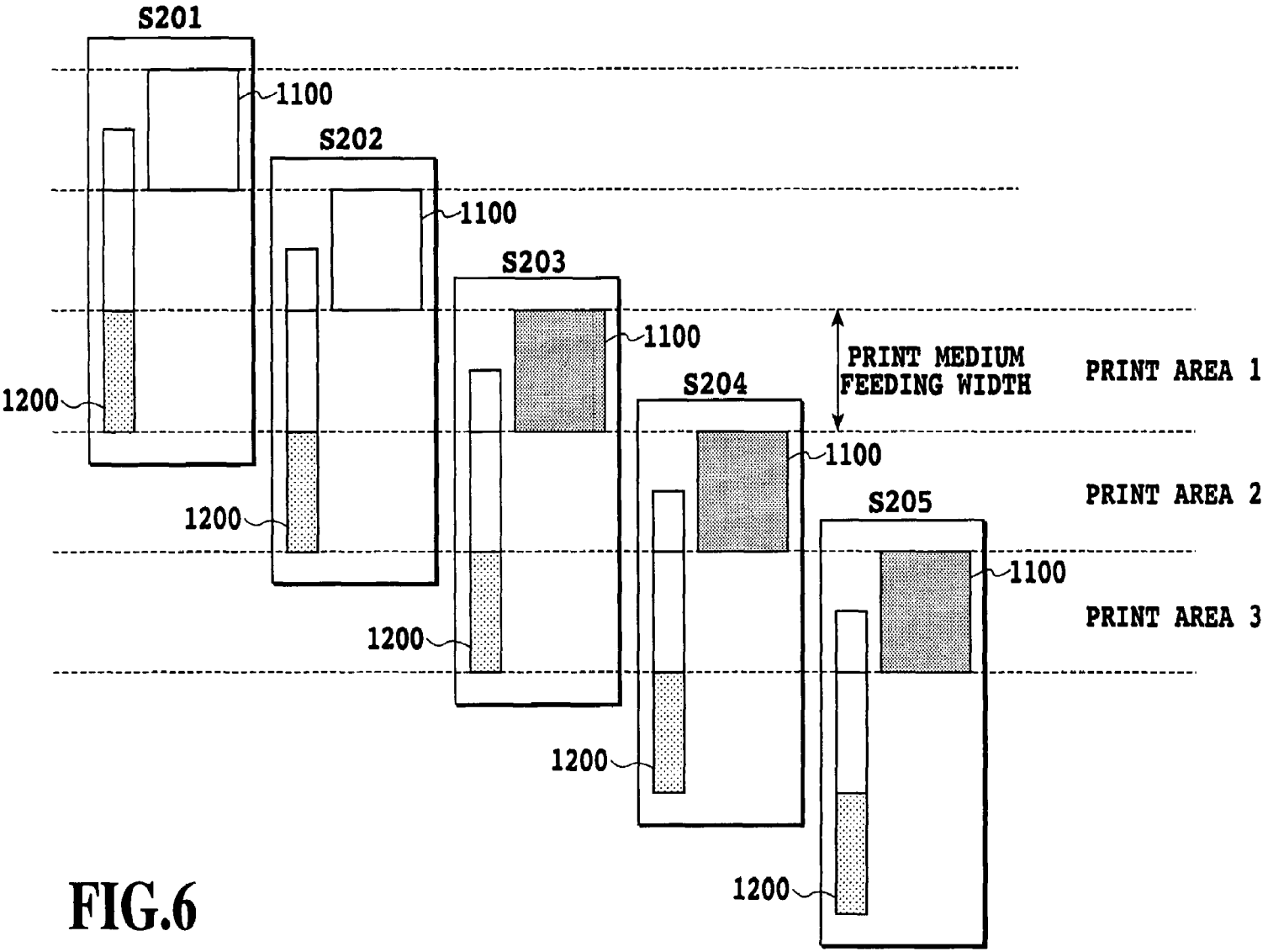
FIG. 6 is a diagram illustrating one pass printing.

FIG. 6 is a diagram schematically illustrating one-pass printing in which a color print is completed during one scan.

In the figure, reference numeral 1100 denotes the color ink chip shown in FIG. 1. Reference numeral 1200 denotes the black ink chip for the pigment black. FIG. 6 shows the width of each ejecting opening row as a width that can be printed by scanning. A shaded part in each chip indicates an ejection opening portion used for printing by scanning. Broken lines in the figure indicate the amount of printing medium conveyed during one sub-scan (paper feeding). Specifically, the amount of printing medium conveyed during one sub-scan is equal to 64n pixels, corresponding to the width of each color ejection opening row in the color ink chip shown in FIG. 2, for one scan of the printing head. Additionally, the lateral direction of the sheet of the drawing corresponds to the scanning direction of the printing head. The upper side of the sheet of the drawing corresponds to the downstream side of the conveying direction of the printing medium.

The one-pass printing according to the present embodiment has the mode in which both black ink chip and color ink chip are used and the mode in which only the color ink chip is used, as described later for the print mode. In the description below, both chips are used. However, clearly, a printing operation similar to the one shown below is also performed in the mode in which only the color ink chip is used. Accordingly, its description is omitted. Further, in the mode in which both chips are used, the ejection rows k1 and k2 for the second black ink in the color ink chip 1100 are not used.

First, in a forward scan S201, a print area 1 is printed using the pigment black ink chip 1200.

Then, the printing medium is conveyed by a distance corresponding to 64n pixels. Then, in a backward scan S202, a print area 2 is printed using the pigment black ink chip 1200.

Then, the printing medium is conveyed by the distance corresponding to 64n pixels. Then, in a forward scan S203, a print area 3 is printed using the pigment black ink chip 1200. At the same time, the print area 1 is printed using the color ink chip 1100.

In the subsequent forward and backward scans S204, S205, . . . between which conveyance by the distance corresponding to 64n pixels is interposed, two print areas are printed using the respective chips as in the case of the scan S203. Thus, an image is completed.

According to the present printing operation, the same print area can be printed one printing scan earlier with the pigment black ink than with the color inks. This allows the color inks to be applied after the pigment black ink has sufficiently permeated through the printing medium. It is thus possible to suppress the possible bleeding between black and the other colors. Furthermore, the non-uniformity of the colors attributed to the application order of the color inks can be reduced because there are a number of dots formed with one of the two application orders as well as the same number of dots formed with the other application order, as described above.

Multi-Pass Printing

In the present embodiment, a random mask is used to generate data for each of a plurality of scans that complete a predetermined print area in multi-pass printing. Then, printing is controlled on the basis of the data generated. The print control will be described below on the basis of the random mask and the data generated using the random mask. The multi-pass printing is in the mode in which the pigment black ink that is the first black ink and the dye black ink that is the second black ink are used in addition to the cyan, magenta, and yellow inks, as described later for the print mode.

(Creation of Random Mask)

Figure 7:
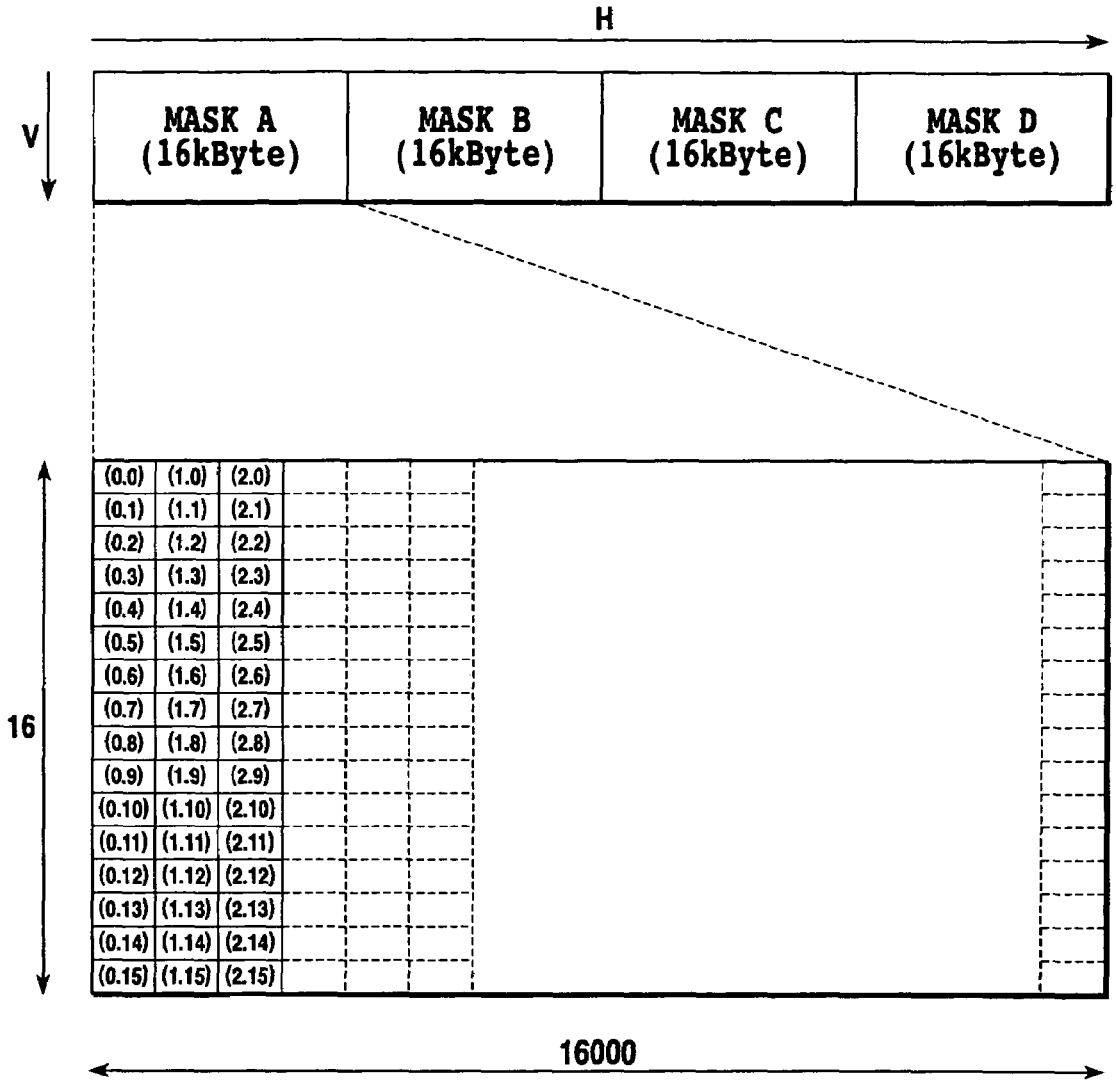
FIG. 7 is a diagram illustrating a mask used for multipass printing.

FIG. 7 is a diagram schematically showing the configuration of a mask that completes an image in the same print area through four scans.

The mask is composed of four areas named a mask A, a mask B, a mask C, and a mask D. Each of the masks A, B, C, and D is composed of 16 kilobytes (1 kilobyte is 16,000 bits). Specifically, as shown in FIG. 7, each mask is composed of 16 bits×16,000 bits. The relationship between the bits in the vertical direction and the bits in the horizontal direction agrees with the relationship between the pixels in the vertical direction and the pixels in the horizontal direction, all the pixels constituting quantized image data. The position of a pixel in the mask is managed by defining the vertical direction as V and the horizontal direction as H as shown by the arrows in the figure. Each of the masks A, B, C, and D can be managed in the horizontal direction H by successively expanding the masks A, B, C, and B on a storage element. According to this manner of management, the leading position of the mask A is (H, V)=(0, 0). The leading position of the mask B is (H, V)=(16,000, 0). The leading position of the mask C is (H, V)=(16,000×2, 0). The leading position of the mask D is (H, V)=(16,000×3, 0).

Figure 8:
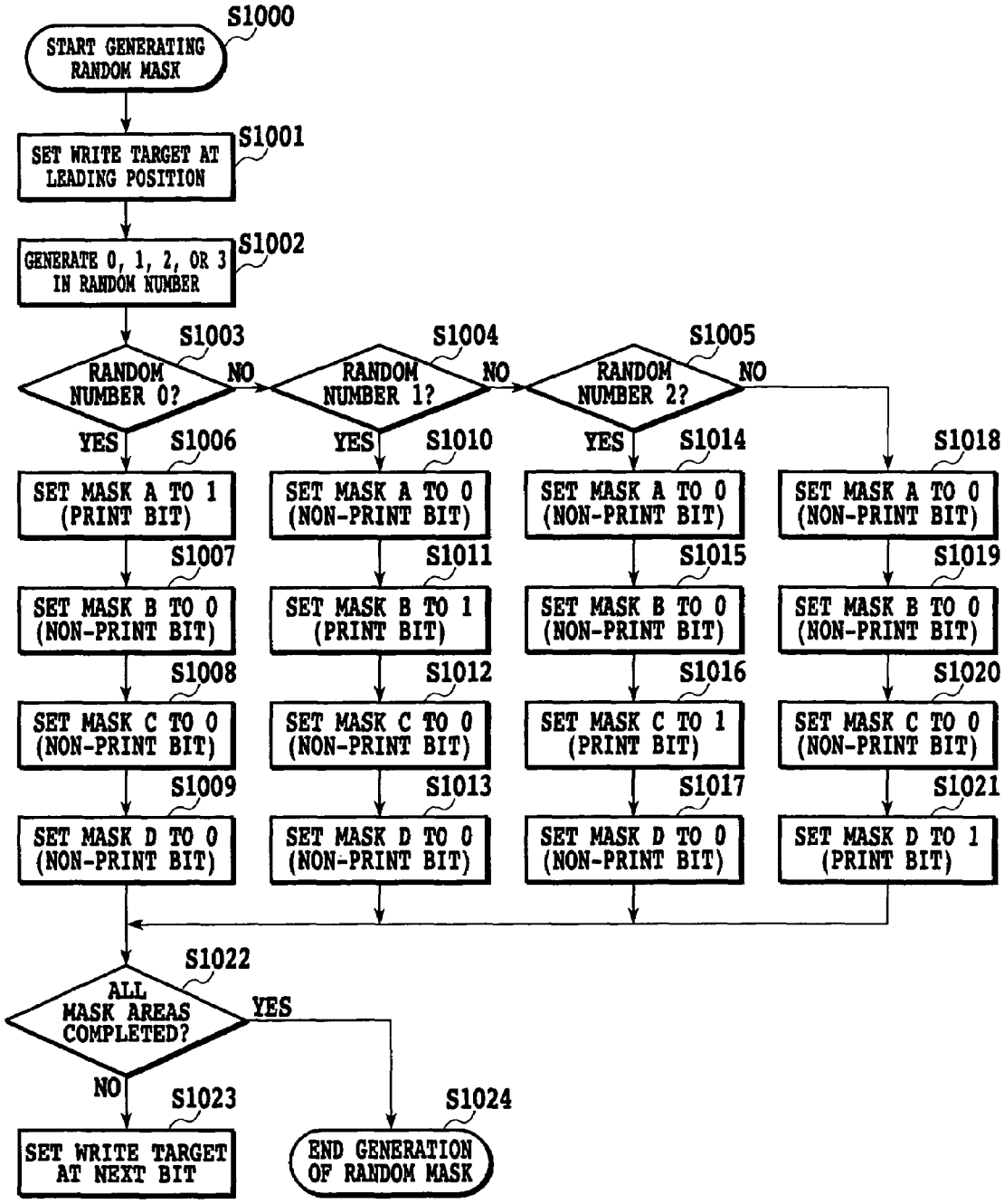
FIG. 8 is a flow chart showing a procedure to generate a random mask.

FIG. 8 is a flow chart showing a procedure to generate a random mask according to the present embodiment.

In step S1000, a random mask starts to be created. Then, in step S1001, a position to start mask setting is set at the leading position of the mask. That is, the mask A is set at (H, V)=(0, 0). The mask B is set at (H, V)=(16,000, 0). The mask C is set at (H, V)=(16,000×2, 0). The mask D is set at (H, V)=(16,000×3, 0). Then, in step S1002, a random number composed of 0, 1, 2, or 3 is generated. Then, in steps S1003, S1004, and S1005, printing or non-printing is set for each mask on the basis of the value of the random number.

If the random number is 0, this is determined in step S1003 and the processing in steps S1006, S1007, S1008, and S1009 is executed. Specifically, in step S1006, 1 is set for the mask A as a print bit. Here, the print bit enables the data on a pixel in the image data which corresponds to a pixel in the mask. If for example, the binary data on that pixel is 1, this means that a dot is formed in that pixel. In contrast, a non-print bit means that the data on a corresponding pixel is disabled. Then, in steps S1007, S1008, and S1009, 0 is set for the masks B, C, and D as a non-print bit. Likewise, if the random number is 1, the print bit is set for the mask B, while the non-print bit is set for the other masks. If the random number is 2, the print bit is set for the mask C, while the non-print bit is set for the other masks. If the random number is 3, the print bit is set for the mask D, while the non-print bit is set for the other masks. After the mask setting has been processed for each pixel, it is determined in step S1022 whether or not the entire area has been set. That is, it is determined whether or not the current setting position is (H, V)=(16,000, 16). If it is determined in step S1022 that not the entire area has been set, the process proceeds to step S1023. In step S1023, a position on the mask is specified which is to be set next time. At this time, 1 is added to the current V coordinate. However, if the current V coordinate is 16, V is set at 1 and 1 is added to the H coordinate for each of the masks A, B, and C, and D. After the process in step S1023, the process proceeds to step S1002 to repeat the above process. If it is determined in step S1022 that the entire area of the mask has been set, the process proceeds to step S1024 to finish the process of generating a random mask.

(Print Control)

The random mask can be set for a printable area on a printing medium. The coordinates of the printable area on the printing medium are defined as Hp in the main scanning direction and Vp in the sub-scanning direction. In the present embodiment, multi-pass printing is executed to complete the image in the same print area via four scans.

The present printer analyzes a command for print data transferred via the I/F 611 (FIG. 5) and expands image data to be printed into the RAM 602. The area (expansion buffer) on the RAM into which the image data is expanded has a horizontal size of Vp pixels corresponding to the printable area and a vertical size of 16n pixels that is one fourth of 64n. Further, the storage area (print buffer) on the RAM 602 which is referenced for scanning has a horizontal size of Vp pixels corresponding to the printable area and a vertical size of 64n pixels, the width in the vertical direction which is printed during a scan of the printing head.

The ASIC of the present printer has a function to specify the start portion of a random mask as the H coordinate in the horizontal direction of the print buffer for every 16 pixels in the vertical direction of the print buffer. The ASIC also has a function to return to the leading position of the random mask upon reaching the terminal of the random mask in the horizontal direction of the print area. That is, for the horizontal direction of the print area, the ASIC repeats H=0 to 16,000 in the horizontal direction of the random mask.

On the basis of the above configuration, during a scan of the printing head, the ASIC associates the image data in the print buffer with the data for the random mask, while directly referencing the storage area to subject both data to AND. The ASIC then transfers driving data to the printing head.

In the present embodiment, an image is completed via four scans, so that an image corresponding to one fourth of the vertical width of the printing head is completed during one scan of the printing head. Accordingly, on the downstream side in the printing medium conveying direction, one fourth of the image data expanded into the print buffer during one scan of the printing head is unwanted. Thus, the unwanted area of the print buffer is used as the expansion buffer to expand the image data, while the storage area that has been used as the expansion buffer is used as one fourth of the print buffer. That is, the storage area is managed for every one fourth of the width printed by a scan of the printing head. Then, the five managed areas are used as the expansion buffer and print buffer in a rotational manner.

Figure 9:
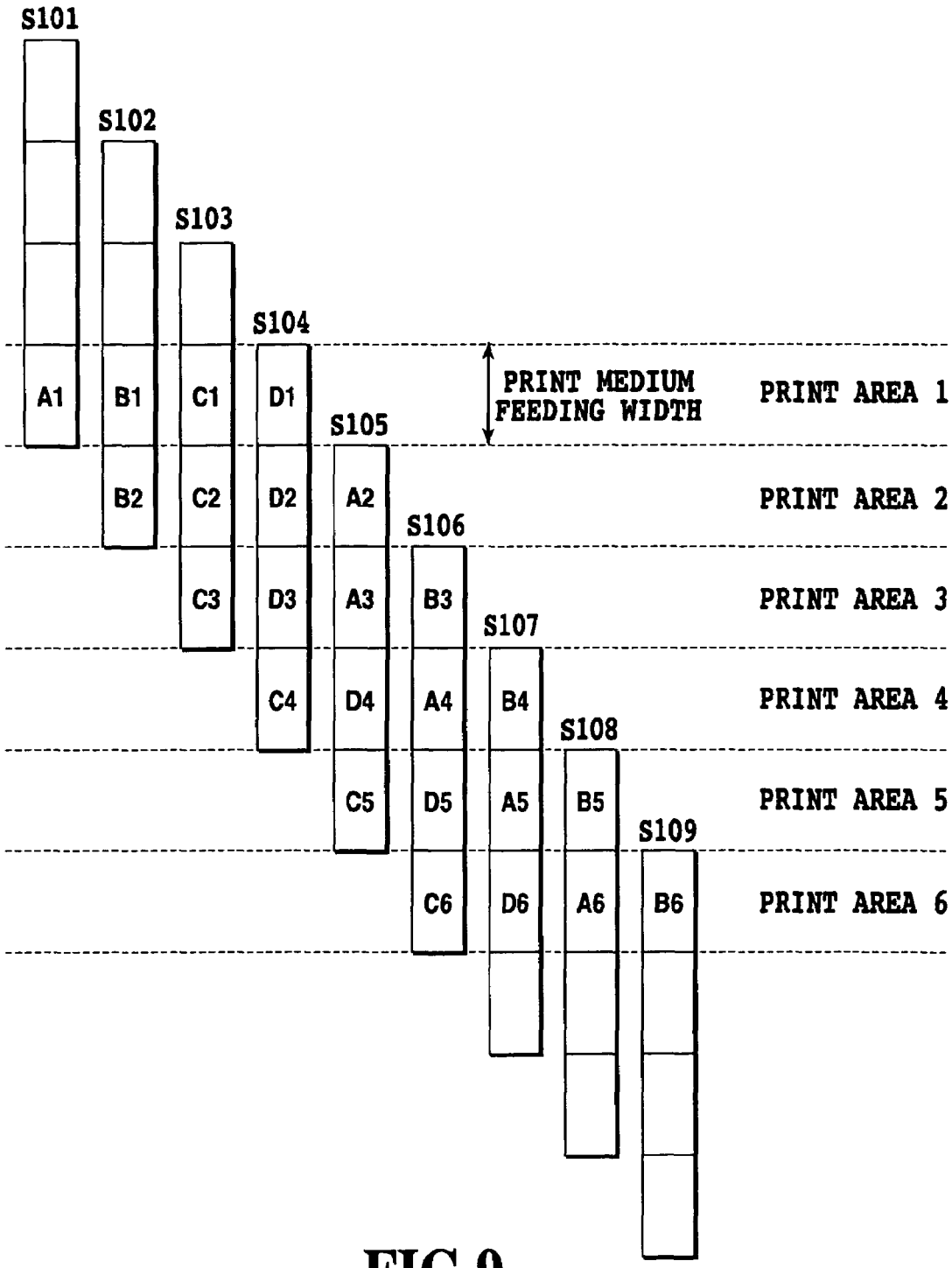
FIG. 9 is a diagram illustrating the multipass printing and a mask pattern used it.

FIG. 9 is a diagram illustrating a mask used for a printing operation and each scan for the printing operation according to the present embodiment.

In the figure, broken lines indicate the amount of printing medium conveyed during one sub-scan. According to the present embodiment, the amount of printing medium conveyed during one sub-scan is 16n pixels, one fourth of the vertical width printed during one scan of the printing head. Additionally, the lateral direction of the sheet of the drawing corresponds to the scanning direction of the printing head. The upper side of the sheet of the drawing corresponds to the downstream side of the conveying direction of the printing medium.

In FIG. 9, reference numerals such as A1, B1, C1, and D1 are the management numbers of start points of the random masks A, B, C, and D. Since the masks have the different start points, the different masks are used for the respective print areas and respective scans. For the same print area, the four masks are complementary to one another. Here, the same number indicates that the start position of the random mask is offset by 16,000 pixels in the horizontal direction.

Overlapping of Black Ink

On the basis of the positions of the ejection opening rows for the second black ink in the printing head shown in FIG. 2, an embodiment of the present invention reduces a difference in coloring associated with the overlapping manner in each direction of the bidirectional printing.

Figure 10:
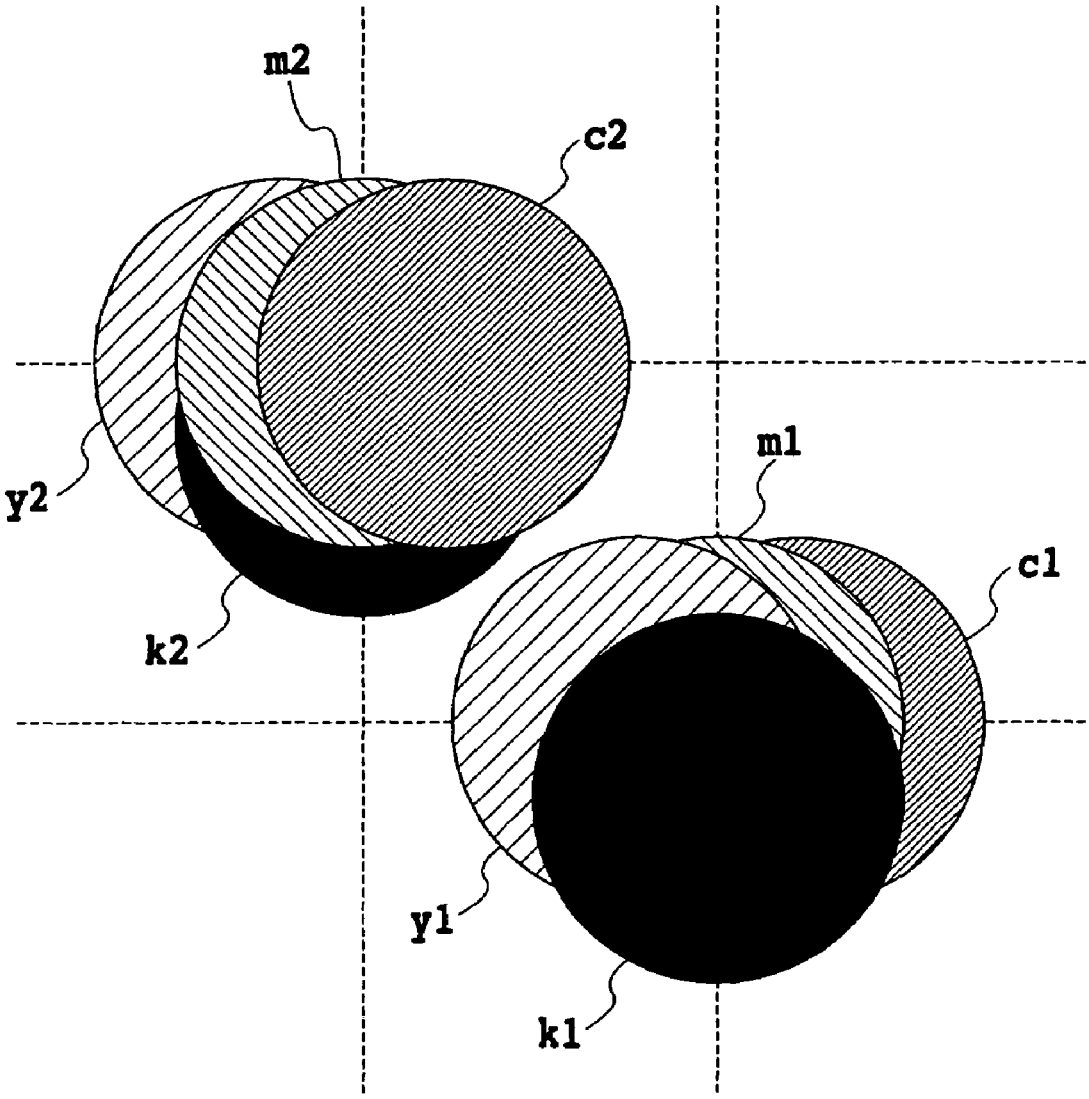
FIG. 10 is a diagram showing the order in which inks are applied to form two dots in the respective pixels if the printing head having the ejection openings arranged as shown in FIG. 2 is scanned toward a first groove 1001.
Figure 11:
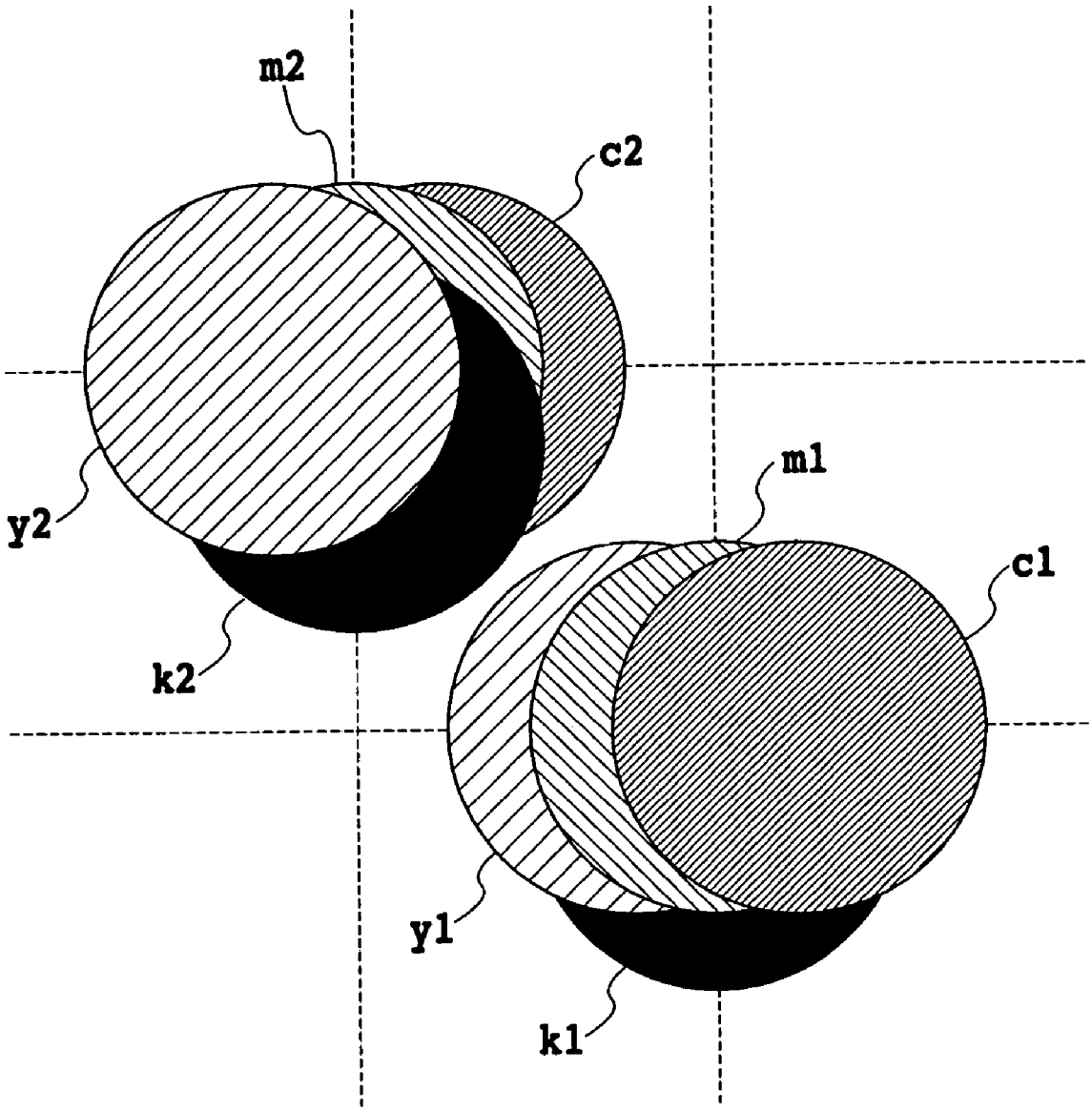
FIG. 11 is a diagram showing the order in which the inks are applied to form two dots if the printing head is scanned in the direction opposite to the scanning direction shown in FIG. 10.
Figure 12:
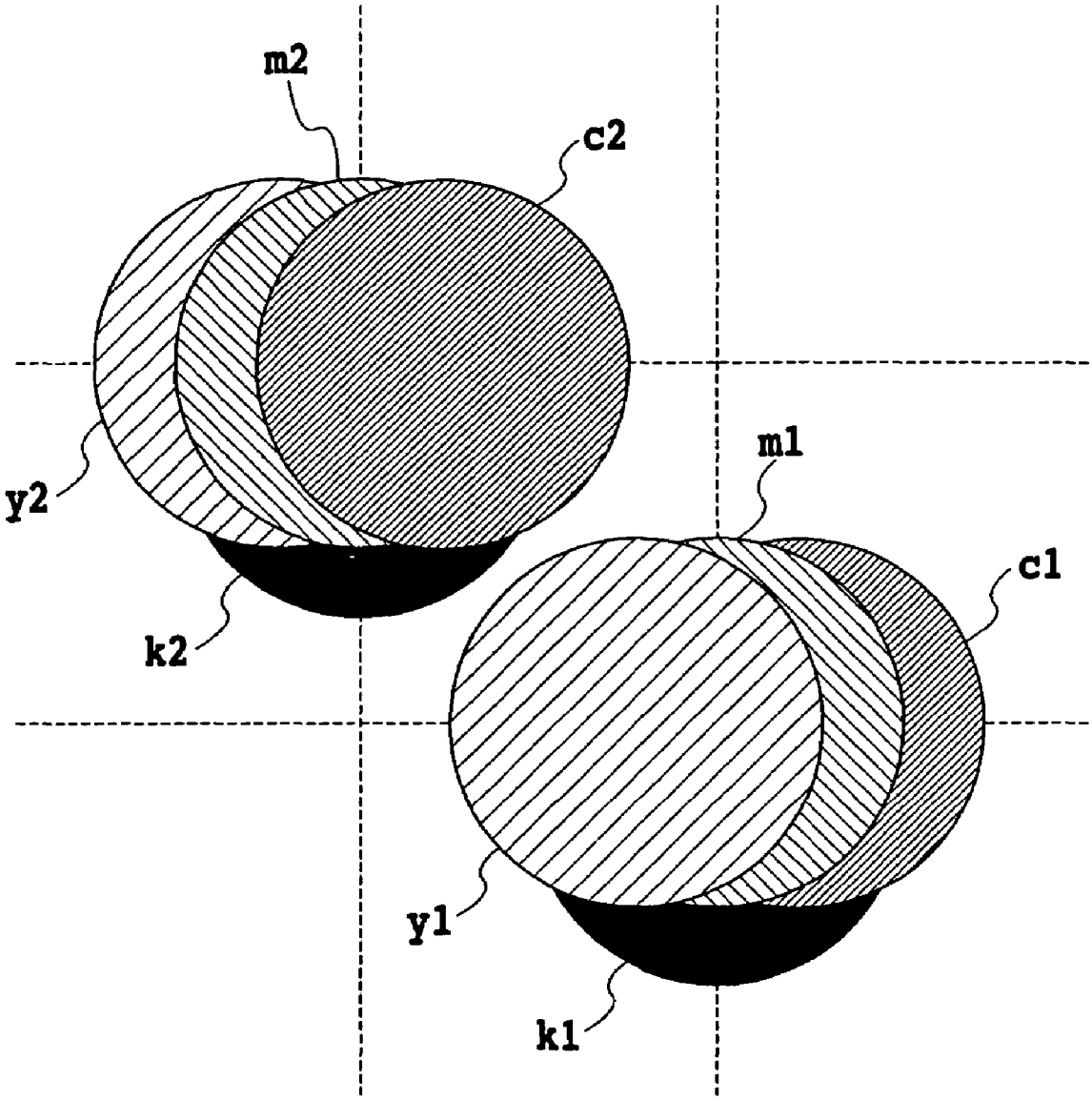
FIG. 12 is a diagram showing the order in which ink dots are applied if a printing head shown in FIG. 16 showing a conventional example is scanned toward a first groove 9001.
Figure 13:
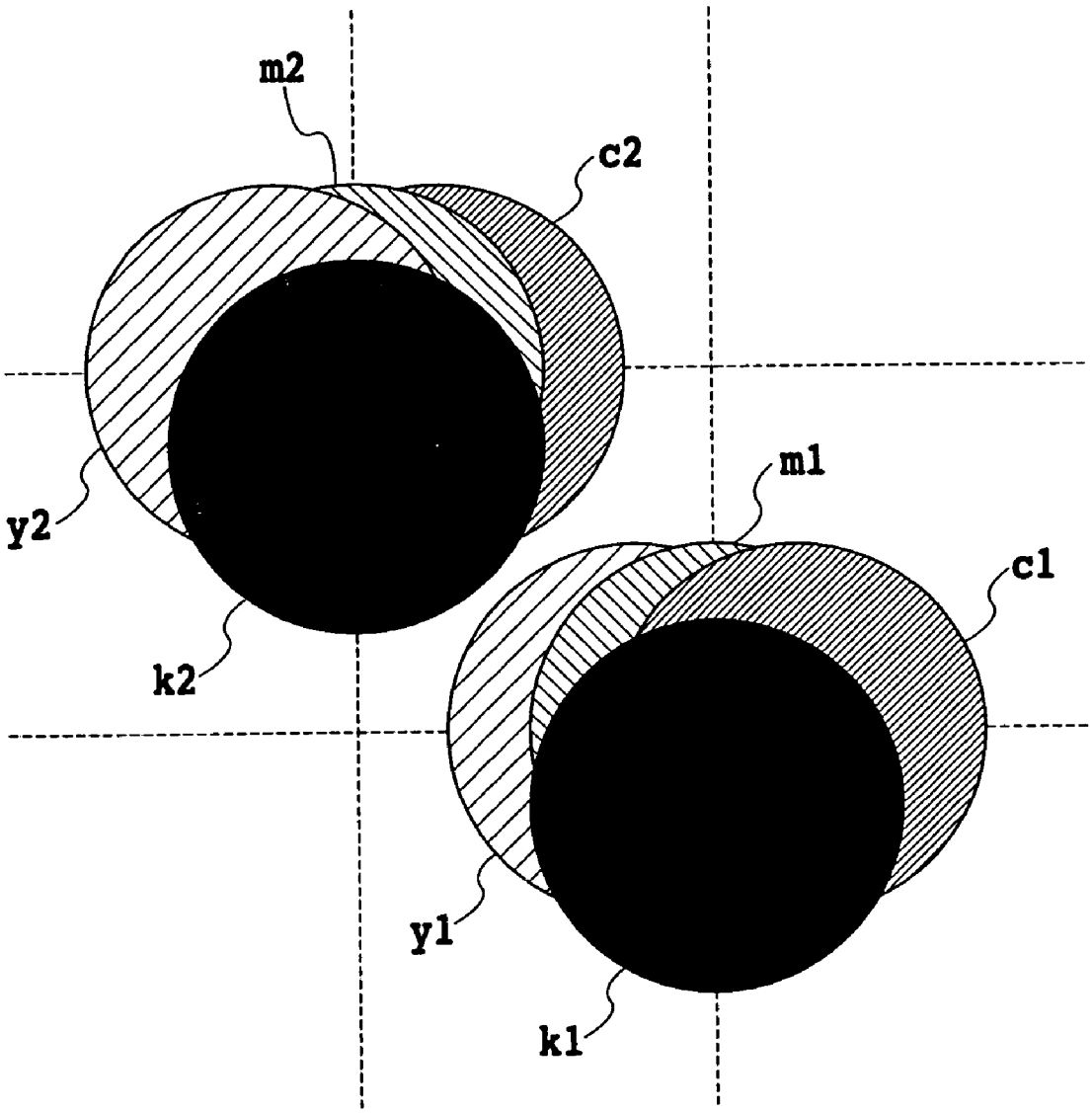
FIG. 13 is a diagram showing the order in which ink dots are applied if the printing head shown in FIG. 16 is scanned toward the direction opposite to the scanning direction shown in FIG. 12.

FIGS. 10 and 11 are schematic diagrams showing how the black is superposed according to the present embodiment, on the basis of the arrangement of the ejection rows shown in FIG. 2. FIGS. 12 and 13 are schematic diagrams showing how the black is superposed on the basis of the arrangement of the ejection rows according to the conventional example shown in FIG. 16.

FIGS. 10, 11, and 12 show the application order of the cyan, magenta, yellow, and black inks used to form two dots for each pixel in each scanning direction of the printing head. An ink applied later is placed at a higher position in a stack of inks. In this figure, as in the case of FIG. 3, the ink dots are shifted from each other to make the reader understand the actual order of superimposition.

Figure 16:
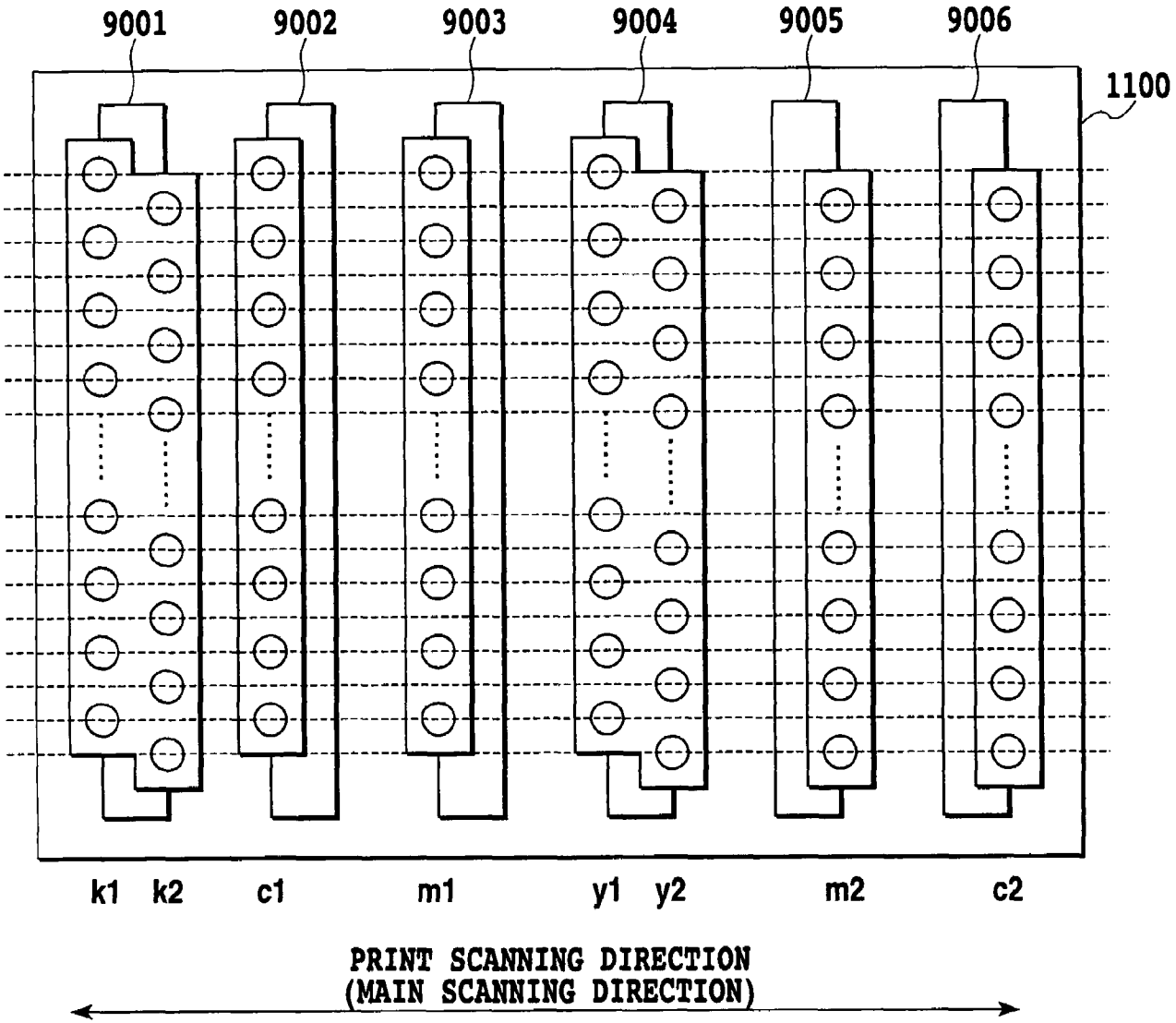
FIG. 16 is a diagram showing the arrangement of ejection opening rows in a color ink chip of a printing head according to a conventional example.
Figure 17:
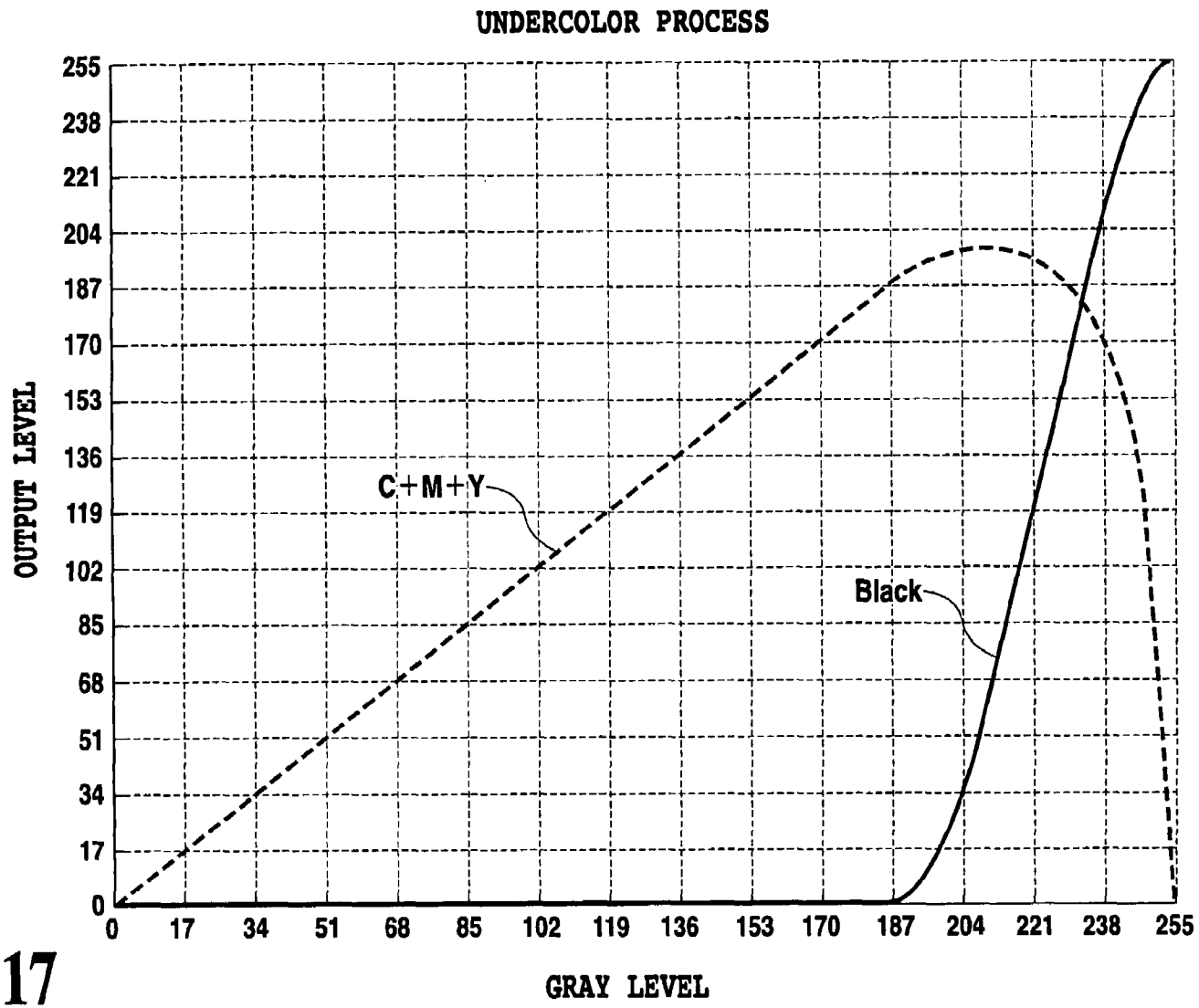
FIG. 17 is a diagram illustrating an example of an undercolor removal process.

FIG. 12 shows the application order of ink dots used when the printing head shown in FIG. 16 as a conventional example is scanned toward the first groove 9001 (this direction will hereinafter referred to be as the forward direction). In this case, if all the inks are superposed on one another, it is possible to form a dot composed of the inks superposed on one another in order of k1, c1, m1, and y1 and a dot composed of the inks superposed on one another in order of k2, y2, m2, and c2. On the other hand, FIG. 13 similarly shows the application order of ink dots used when the printing head shown in FIG. 16 is scanned in the direction opposite to the scanning direction shown in FIG. 12, that is, the backward direction. In this case, if all the inks are superposed on one another, it is possible to form a dot composed of the inks superposed on one another in order of y1, m1, c1, and k1 and a dot composed of the inks are superposed on one another in order of c2, m2, y2, and k2.

As described above, in an embodiment of the present invention, in contrast to the conventional example shown in FIG. 16, in which the ejection rows for the black ink are arranged at the end of the arrangement of the color ejection rows, the ejection rows for the black ink are arranged between the ejection rows for the color inks other than the black ink. This provides the dot superimpositions shown in FIGS. 10 and 11, through a forward and backward scans, respectively. This serves to reduce the difference in coloring between a dot formed during a forward scan and a dot formed during a backward scan as shown in FIGS. 10 and 11.

Specifically, the arrangement of the ejection opening rows shown in FIG. 2 is determined by varying the positional relationship between the ejection opening rows for cyan, magenta, and yellow and the ejection opening rows for the black ink and visually evaluating a difference in color between a forward scan and a backward scan to find an arrangement with the smallest color difference. Specifically, as previously described, the inventors focus on the fact that a dot formed by superposing one, two, or all of the cyan ink, magenta ink, and yellow ink, and the black ink is differently colored depending on the overlapping manner, that is, the order of the black ink which is superposed in relation to the color inks, or to which color ink the black ink is superposed to be adjacent. On the basis of this point, the inventors have determined the arrangement of the ejection opening rows with the smallest color difference as described above.

In the present embodiment, two types of dots based on different superimposition manners are arranged on one pixel as shown in FIGS. 10 and 11. However, if a dot based on one type of superimposition manner, that is, one dot is formed in each pixel, it is of course possible to use the above described viewpoint and estimations similar to those based on the model described below.

In the description below, modeling will be used to consider the difference in the coloring of a dot attributed to the bidirectional printing or the position of the black ink in a stack of the superposed inks.

The coloring of color ink dots will be considered using a color space based on the optical reflection densities of cyan, magenta, yellow. The optical reflection densities (hereinafter simply referred to as densities) of dots of the cyan, magenta, yellow, and black inks are expressed using the color space as follows:

$$Vc=(vc,0,0)$$

$$Vm=(0,vm,0)$$

$$Vy=(0,0,vc)$$

$$Vk=(A\times vc,\ B\times vm,\ C\times vc)$$

Here, in each of these color components, the black ink is used to increase the density above the cyan, magenta, and yellow inks. Accordingly, the following expression is established.

$$A=1,\ B=1,\ C=1 \tag{1}$$

The components of the optical reflection densities of cyan, magenta, and yellow are shown to have a value of zero because the other components have relatively small values.

Then, the contribution efficiency of the ink application order to the coloring (density) is numerically expressed as f1, f2, f3, and f4, where f1 corresponds to the earliest application. Here, as previously described, for common print media, the contribution rate to the coloring is higher as the application is earlier. Accordingly, the following expression is established:

$$f1>f2>f3>f4>0 \tag{2}$$

Under the above modeling, the coloring of the dots shown in FIGS. 12 and 13 and obtained using the arrangement of the ejection opening rows shown in FIG. 16 according to the conventional example is determined.

First, the coloring E1 of the dot shown in FIG. 12 and obtained by superposing the inks k1, c1, m1, and y1 on one another is:

$$E1=f1\times Vk+f2\times Vc+f3\times Vm+f4\times Vy \tag{3}$$

The coloring E2 of the dot obtained by superposing the inks k2, y2, m2, and c2 on one another is:

$$E2=f1\times Vk+f4\times Vc+f3\times Vm+f2\times Vy \tag{4}$$

Thus, the coloring E3 of the two dots shown in FIG. 12 is expressed as the sum of the above colorings as follows:

$$E3=E1+E2=(2\times f1)\times Vk+(f2+f4)\times Vc+(2\times f3)\times Vm+(f2+f4)\times Vy \tag{5}$$

On the other hand, the coloring E4 of the dot shown in FIG. 13 and obtained by superposing the inks y1, m1, c1, and k1 on one another is:

$$E4=f4\times Vk+f3\times Vc+f2\times Vm+f1\times Vy \tag{6}$$

The coloring E5 of the dot obtained by superposing the inks c2, m2, y2, and k2 on one another is:

$$E5=f4\times Vk+f1\times Vc+f2\times Vm+f3\times Vy \tag{7}$$

The coloring E6 of the two dots shown in FIG. 13, the sum of the above colorings, is:

$$E6=2\times f4\times Vk+(f1+f3)\times Vc+(2\times f2)\times Vm+(f1+f3)\times Vy \tag{8}$$

As a result, a difference ΔEa in coloring attributed to bidirectional printing is:

$$\Delta Ea=|E3-E6|=|2(F1-F4)\times Vk+(f2-F1+F4-F3)\times Vc+2)(f3-F2)\times Vm+(f2-f1+f4-f3)\times Vy| \tag{9}$$

Here, it is assumed that f1−f2=F1, f2−f3=F2, and f3−f4=F3. Then, on the basis of Expression (2), $$F1>0,\ F2>0,\ F3>0$$

Accordingly, ΔEa is:

$$\Delta Ea=|2(F1+F2+F3)\times Vk-(F1+F3)\times Vc-2\times F2\times Vm-(F1+F3)\times Vy| \tag{10}$$

As described above, FIG. 10 shows the order in which the inks are applied to form two dots for the respective pixels if the printing head with the arrangement of the ejection opening rows shown in FIG. 2 is scanned toward the first groove 1001 according to an embodiment of the present invention (this direction is referred to as the forward direction). If all the inks are superposed on one another, it is possible to form a dot composed of the inks superposed on one another in order of c1, m1, y1, and k1 and a dot composed of the inks superposed on one another in order of y2, k2, m2, and c2. FIG. 11 shows the order in which the inks are applied to form two dots if the printing head shown in FIG. 2 is scanned in the direction opposite to the scanning direction shown in FIG. 10, that is, the backward direction. In this case, if all the inks are superposed on one another, it is possible to form a dot composed of the inks superposed on one another in order of k1, y1, m1, and c1 and a dot composed of the inks are superposed on one another in order of c2, m2, k2, and y2.

Similarly, the same modeling is used to consider the difference in the coloring of a dot between the two directions of the bidirectional printing.

The coloring E7 of the dot shown in FIG. 10 and obtained by superposing the inks c1, m1, y1, and k1 on one another is:

$$E7=f4\times Vk+f1\times Vc+f2\times Vm+f3\times Vy \quad (11)$$

The coloring E8 of the dot obtained by superposing the inks y2, k2, m2, and c2 on one another is:

$$E8=f2\times Vk+f4\times Vc+f3\times Vm+f1\times Vy \quad (12)$$

Thus, the coloring E9 of these two dots shown is expressed as the sum of the above colorings as follows:

$$E9=E7+E8=(f2+f4)\times Vk+(f1+f4)\times Vc+(f2tf3)\times Vm+(f1+f3)\times Vy \quad (13)$$

On the other hand, the coloring E10 of the dot shown in FIG. 11 and obtained by superposing the inks k1, y1, m1, and c1 on one another is:

$$E10=f1\times Vk+f4\times Vc+f3\times Vm+f2\times Vy \quad (14)$$

The coloring E11 of the dot obtained by superposing the inks c2, m2, k2, and y2 on one another is:

$$E11=f3\times Vk+f1\times Vc+f2\times Vm+f4\times Vy \quad (15)$$

The coloring E12, the sum of the colorings of the two dots, is:

$$E12=E10+E11=(f1+f3)\times Vk+(f1+f4)\times Vc+(f2+f3)\times Vm+(f2+f4)\times Vy \quad (16)$$

Thus, the difference ΔEa in coloring between the two directions of the bidirectional printing according to the present embodiment is: $\Delta Ea=|E9-E12|=|-(f1-f2+f3-f4)\times Vk+(f1-f2+f3-f4)\times Vy|$ or $$\Delta Eb=(F1+F3)\times|Vy-Vk| \quad (17)$$

Then, the determined density difference ΔEa according to the conventional example is compared with the determined ΔEb according to the present embodiment. The densities ΔEa and ΔEb are expressed using the components Vc, Vm, and Vy. Then, on the basis of Equation (10), the following equation is given:

$$\Delta Ea^2=\{(2A-1)\times(F1+F3)+2A\times F2\}^2\times vc2+\{2B\times(F1+F3)+2(B-1)\times F2\}^2\times vm^2+\{(2C-1)\times(F1+F3)+2C\times F2\}^2\times vy^2 \quad (18)$$

Likewise, on the basis of Equation (17), the following equation is given:

$$\Delta Eb^2=\{A\times(F1+F3)\}^2\times vc^2+\{B\times(F1+F3)\}^2\times vm^2+\{(C-1)\times(F1+F3)\}^2\times vy^2 \quad (19)$$

Thus, the difference between $\Delta Ea^2$ and $\Delta Eb^2$ is:

$$\Delta Ea^2-\Delta Eb^2=\{(3A-1)\times(F1+F3)+2A\times F2\}\times\{(A-1)\times(F1+F3)+2A\times F2\}\times vc^2+\{3B\times(F1+F3)+2(B-1)\times F2\}\times\{B\times(F1+F3)+2(B-1)\times F2\}\times vm^2+\{(3C-2)\times(F1+F3)+2C\times F2\}\times\{C\times(F1+F3)+2C\times F2\}\times Vy^2 \quad (20)$$

When the relationship in Expression (1) is applied to Equation (20), the following expression is established.

$\Delta Ea^2-Eb^2>0$, that is, ΔEa>ΔEb.

With such estimations based on the modeling, the printing head with the arrangement of the ejection opening rows according to the present embodiment shown in FIG. 2 provides a smaller difference in coloring between the two scanning directions of the bidirectional printing than the printing head with the arrangement of the ejection opening rows according to the conventional example shown in FIG. 16.

Equation (17) indicates that the difference ΔEb is determined by the difference in coloring (density) between the black ink and the yellow ink. That is, as is apparent from the arrangement of the ejection opening rows shown in FIG. 2, when the ejection opening rows for the black ink are arranged adjacent to the ejection opening rows for the yellow ink, specifically, when the ejection opening rows for the black ink are arranged adjacent to the ejection opening rows for the yellow ink, which is located most inside if the ejection opening rows for the yellow, magenta, and cyan inks are symmetrically arranged, the difference in color between the forward and backward directions is determined by the difference in coloring (density) between the black ink and the yellow ink as indicated by Equation (17). In this case, the ejection opening rows for the black, magenta, and cyan inks maybe considered to be symmetrically arranged. Then, the asymmetrically arranged ejection opening rows for the yellow ink are adjacent to the most inside ejection opening rows for the black ink. In other words, if the difference in coloring between the yellow ink and the black ink is smaller than that between the other inks and the black ink, the arrangement of the ejection opening rows shown in FIG. 2 minimizes the color drift resulting from the bidirectional printing. Therefore, if the coloring of the cyan or magenta ink is closer to the coloring of the black ink than the coloring of the yellow ink, then in FIG. 2, the ejection opening rows for this ink are desirably arranged at the positions of the ejection opening rows for the yellow ink.

Figure 14:
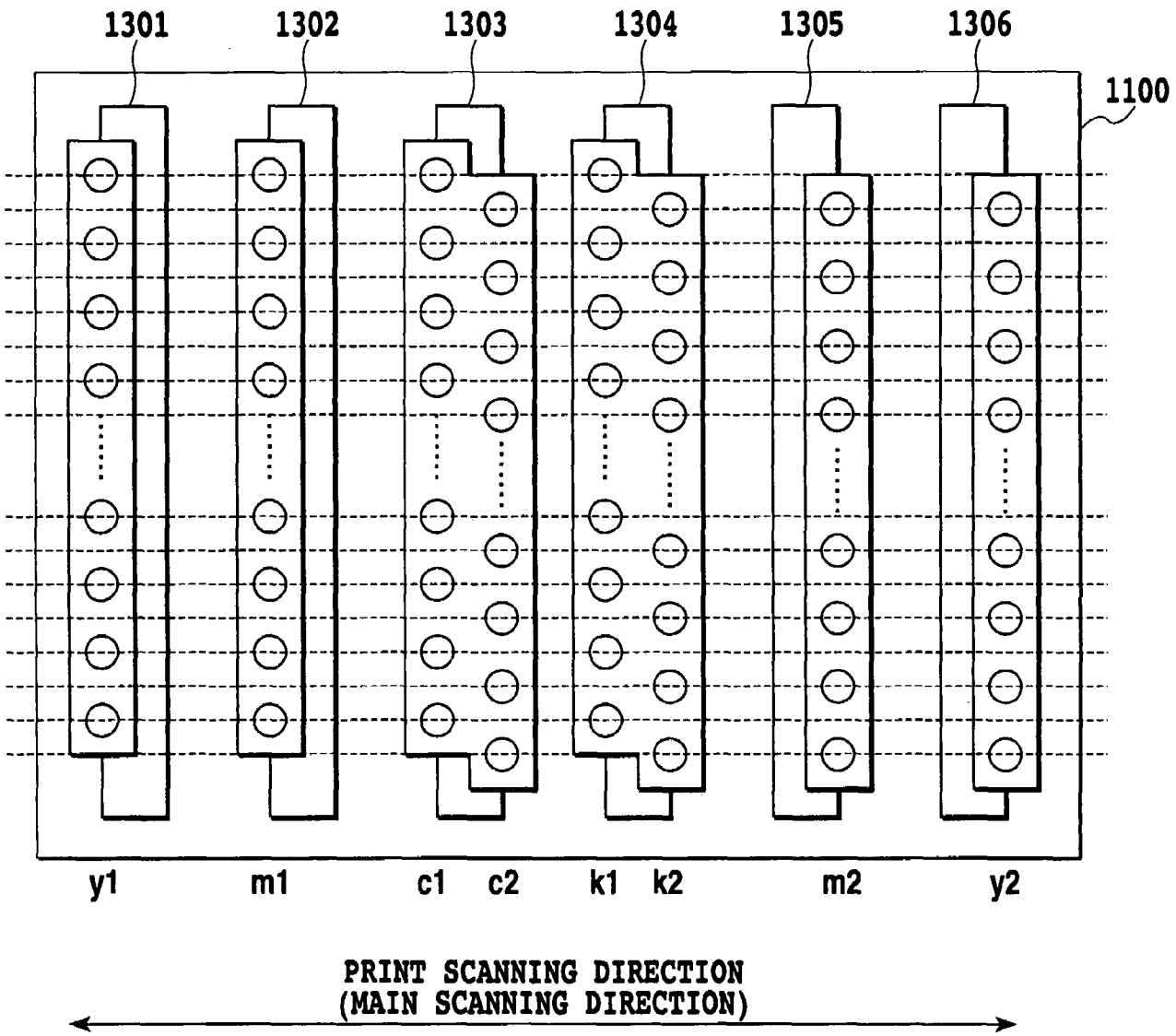
FIG. 14 is a diagram showing the arrangement of ejection opening rows in a variation of the color ink chip of the printing head used in the first embodiment of the present invention.

If for example, the coloring of the cyan ink is the closest to the coloring of the black ink, the difference in coloring attributed to the bidirectional printing is minimized using the arrangement of the ejection opening rows shown in FIG. 14.

In the present embodiment, the printing head with the above described arrangement of the ejection openings is used, and bidirectional multi-pass printing is carried out using this printing head. This also reduces the non-uniformity of the colors in an image which may result from a difference in coloring between the two scanning directions.

Print Mode

In the present embodiment, in a configuration that executes bidirectional printing using many types of inks, different print modes are executed depending on the types of inks used in order to suppress the non-uniformity of the colors or color drifts attributed to the bidirectional printing.

In the present embodiment, as shown in Table 1 below, if only the ejection opening rows for the cyan, magenta, and yellow inks in the color ink chip 1100 (FIG. 2) of the printing head are used, and if not only the ejection opening rows for these inks but also the black ink chip 1200 for the pigment black ink are used, then one-pass bidirectional printing is executed on the basis of binary data. This is because for each pixel and for the entire image, the number of dots formed with one of the two ink application orders or superimposition manners can be set to be the same as that formed with the other ink application order or superimposition manner. Further, in the print mode of the present embodiment in which the pigment black ink is used, the pigment black ink is not superposed on any color inks such as the cyan ink. This avoids the application order problem.

On the other hand, if the ejection opening for the dye black ink in the color ink chip 1100 is used in addition to the ejection openings for the color inks such as the cyan ink, multi-pass printing is executed on the basis of three-valued data. Specifically, in the present embodiment, to more favorably express, for example, the gray level, the dye black is superposed on the other color inks at a relatively high gray level. In this case, as shown in FIG. 2, since the ejection opening rows k1 and k2 for the dye black ink are not symmetrically arranged, the difference in the application order of the dye black ink and other color inks cannot be eliminated for each pixel. Accordingly, even with dependence on image date, the multi-pass printing is executed to make the number of dots formed with one of the two application orders as similar as possible to that formed with the other application order, for each raster or for the entire image. That is, as previously described, if in addition to the symmetrically arranged ejection opening rows for the cyan, magenta, and yellow inks, another color or type of ink is used, when all these ejection opening rows are symmetrically arranged in association with the bidirectional printing, the size of the printing head increases. Accordingly, the ejection opening rows for such an ink are asymmetrically arranged between two rows constituting a group of symmetrically arranged ejection opening rows or outside the group as shown in FIG. 2. Then, in the print mode using these ejection opening rows, multiple passes are used to execute bidirectional printing. The term "symmetrical arrangement" of the ejection openings or ejection opening rows need not necessarily mean that the ejection openings or ejection opening rows are geometrically symmetric with respect an axis orthogonal to the scanning direction. As shown in FIGS. 2 and 10, between the symmetrical ejection opening rows, the ejection openings may positionally deviate from each other in the axial direction. Alternatively, asymmetrically arranged ejection openings or ejection opening rows may be arranged between two arbitrary rows constituting a group of symmetrically arranged ejection opening rows.

As described above, the dye black ink is used when the multi-pass printing is executed taking the application order into account. However, for example, the gray level can of course be expressed by superposing the pigment black ink on the other inks. In such a mode, the multi-pass printing may be executed as described above.

Table 1 below shows a specific example of the use of the print modes according to the present embodiment described above.

In Table 1, a mode 1 is a print mode in which the cyan, magenta, yellow, and pigment black inks are used to print ordinary paper at high speed without using the dye black. In the mode 1, one-pass bidirectional printing is executed.

In a mode 2, the same inks as those in the mode 1 are used to print ordinary paper so as to achieve a high grade. In this case, it is possible to execute the one-pass bidirectional printing taking the possible non-uniformity of the colors into account. However, since the multi-pass printing generally provides a high-quality image, the multi-pass bidirectional printing is executed. Further, in addition to the pigment black ink, the dye black ink may be used to, for example, smooth the expression of the gray level. The dye black is suitable for the gray level expression because dye print dots have a lower optical density than pigment print dots.

In a mode 3, the cyan, magenta, and yellow inks are used to print coat paper at high speed. Thus, the one-pass bidirectional printing is executed.

In a mode 4, the dye black, cyan, magenta, and yellow inks are used to print coat paper so as to obtain a high-quality image. Thus, the multi-pass bidirectional printing is executed.

In a mode 5, the dye black, cyan, magenta, and yellow inks are used to print gloss paper so as to obtain a high-quality image. Thus, the multi-pass bidirectional printing is executed.

TABLE 1

| Print mode name | Printing medium | Inks used | Print control |
|---|---|---|---|
| Mode 1 | Ordinary paper | Pigment black, cyan, magenta, yellow | One pass |
| Mode 2 | Ordinary paper | Pigment black (dye black), cyan, magenta, yellow | Multi-pass |
| Mode 3 | Coat paper | Cyan, magenta, yellow | One pass |
| Mode 4 | Coat paper | Dye black, cyan, magenta, yellow | Multi-pass |
| Mode 5 | Gloss paper | Dye black, cyan, magenta, yellow | Multi-pass |

The print mode may be selected by the operator via the group of switches 620 or the host apparatus 610. Alternatively, for example, the present printer or the host apparatus may determine the type of a printing medium and the type of an image to be printed (for example, a document, a graph, or a photograph) and select the print mode in accordance with the determinations.

Second Embodiment

As described above in the first embodiment, the difference in coloring between the forward printing and the backward printing can be reduced when the asymmetrically arranged ejection opening rows for the (black) ink are arranged adjacent to the most inside one of the symmetrically arranged ink ejection opening rows. In the present embodiment, asymmetrically arranged ejection opening rows for two ink colors are added to the symmetrically arranged ejection opening rows for the cyan, magenta, and yellow inks.

Figure 15:
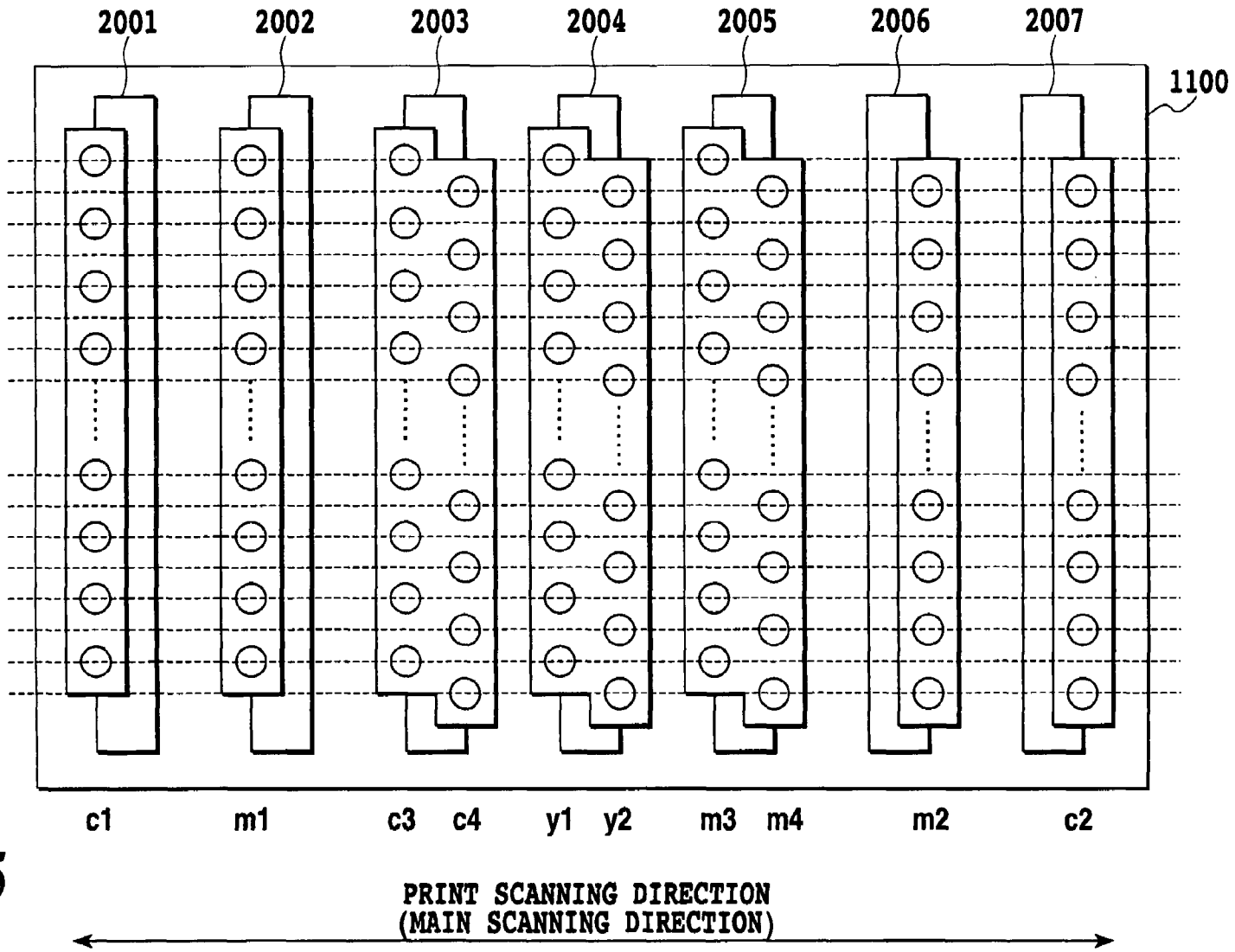
FIG. 15 is a diagram showing the arrangement of ejection opening rows in a color ink chip of a printing head used in a second embodiment of the present invention.

FIG. 15 is a diagram showing the arrangement of the ejection opening rows in the color ink chip 1100 according to the present embodiment. In the present embodiment, a low concentration cyan ink (light cyan ink; nozzle rows c3 and c4) and a low concentration magenta ink (light magenta ink; nozzle rows c3 and c4) are additionally used. Thus, light cyan and light magenta are used to express an image in a low-lightness part, thus avoiding the granular impression.

As shown in FIG. 15, the color ink chip 1100 is provided with seven grooves. Specifically, a first groove 2001, a second groove 2002, a third groove 2003, a fourth groove 2004, a fifth groove 2005, a sixth groove 2006, and a seventh groove 2007 are formed in this order in the scanning direction. In the present embodiment, the cyan ink is supplied to the first groove 2001 and seventh groove 2007. The magenta ink is supplied to the second groove 2002 and sixth groove 2006. The light cyan ink is supplied to the third groove 2003. The light magenta ink is supplied to the fifth groove 2005. Then, the cyan nozzle row c1, composed of 64n (n is an integer equal to or larger than 1; for example, n=4) ejection openings, is formed in the first groove 2001. The magenta nozzle row m1, composed of 64n ejection openings, is formed in the second groove 2002. The light cyan nozzle row c3, composed of 64n ejection openings, is formed on the second groove side of the third groove 2003. The light cyan nozzle row c4, composed of 64n ejection openings, is formed on the fourth groove side of the third groove 2003. The yellow nozzle row y1, composed of 64n ejection openings, is formed on the third groove side of the fourth groove 2004. The yellow nozzle row y2, composed of 64n ejection openings, is formed on the fifth groove side of the fourth groove 2004. The light magenta nozzle row m3, composed of 64n ejection openings, is formed on the fourth groove side of the fifth groove 2005. The light magenta nozzle row m4, composed of 64n ejection openings, is formed on the sixth groove side of the fifth groove 2005. The magenta nozzle row m2, composed of 64n ejection openings, is formed in the sixth groove 2006. The cyan nozzle row c2, composed of 64n ejection openings, is formed in the seventh groove 2007.

In the present embodiment, according to estimations based on modeling similar to those described above in the first embodiment, the nozzle rows c3, c4, m3, and m4, for which the application order cannot be controlled between the forward scanning and the backward scanning, that is, the asymmetrically arranged nozzle rows c3, c4, m3, and m4, are arranged adjacent to the most inside nozzle rows y1 and y2 of the other symmetrically arranged nozzle rows. Then, it is possible to reduce the difference in color between the forward scanning and the backward scanning. Consequently, the difference in color between the yellow ink and the light cyan or magenta ink determines the difference in color between the forward scanning and the backward scanning. In terms of lightness, the coloring of the light cyan and magenta inks is closer to the coloring of the yellow ink than the coloring of the cyan and magenta inks. Accordingly, the present embodiment uses the arrangement of the ejection opening rows shown in FIG. 15. That is, the configuration according to the present embodiment is more advantageous than the configuration in which the nozzle rows for the cyan and magenta inks are arranged at the positions of the nozzle rows c3, c4, m3, and m4.

In the first embodiment, the ink (black ink) ejected from the nozzle rows k1 and k2 for which the ink application order varies depending on the scanning direction is achromatic. Accordingly, the nozzle rows a plurality of which have the application order controlled can be efficiently used to reduce the difference in coloring between the two scanning directions.

Here, the printing head with the arrangement of the ejection rows shown in FIG. 2 is used to carry out printing using only the yellow and black inks, the use of which can be avoided through image processing in actually printing an image. Then, on the basis of modeling, the difference ΔEc in coloring between the two scanning directions is determined as described in the above embodiment.

$$\Delta Ec = 2 \times F1 \times |Vy - Vk|$$

In actual printing, the tendency is that F1>>F2 and F3.

Then, the difference for the yellow and black inks is compared with the difference for the process black and black ink.

$$\Delta Ec / \Delta Eb \cong 2$$

In the former case, a difference occurs in the scanning direction which is nearly double that which occurs in the latter case.

In the present embodiment, a color difference occurs between the light cyan ink and the light magenta ink and the yellow ink. Accordingly, the impact of the difference is lighter than that of the difference for the yellow and black inks. However, in the present embodiment, it is difficult to avoid the above combination of the inks through image processing as described in the first embodiment. It is thus effective to also use a multi-pass printing configuration using a plurality of printing scans as previously described.

The present embodiment also uses print modes in accordance with the types of inks. Table 2 below shows a specific example of the use of the print modes.

In a mode 1, the cyan, magenta, yellow, and pigment black inks are used to print ordinary paper at high speed. In the mode 1, the one-pass bidirectional printing is executed.

In a mode 2, the cyan, magenta, yellow, and pigment black inks as well as the light cyan and magenta inks are used to print ordinary paper so as to achieve a high grade. Thus, in the mode 1, the multipass bidirectional printing is executed.

In a mode 3, the cyan, magenta, and yellow inks are used to print coat paper at high speed. Thus, the one-pass bidirectional printing is executed.

In a mode 4, the cyan, magenta, yellow, light cyan, and light magenta inks are used to print coat paper so as to obtain a high-quality image. Thus, the multi-pass bidirectional printing is executed.

In a mode 5, the cyan, magenta, yellow, light cyan, and light magenta inks are used to print gloss paper so as to obtain a high-quality image. Thus, the multi-pass bidirectional printing is executed.

TABLE 2

| Print mode name | Printing medium | Inks used | Print control |
|---|---|---|---|
| Mode 1 | Ordinary paper | Pigment black, cyan, magenta, yellow | One pass |
| Mode 2 | Ordinary paper | Pigment black, cyan, magenta, yellow, light cyan, light magenta | Multi-pass |
| Mode 3 | Coat paper | Cyan, magenta, yellow | One pass |
| Mode 4 | Coat paper | Cyan, magenta, yellow, light cyan, light magenta | Multi-pass |
| Mode 5 | Gloss paper | Cyan, magenta, yellow, light cyan, light magenta | Multi-pass |

Other Embodiments

In the above first embodiment, the dye black ink is added to the cyan, magenta, and yellow inks to enable the gray level to be appropriately expressed. In the second embodiment, the light cyan and magenta inks are used to enlarge a color reproduction area for a low-lightness part. However, of course, the inks added to the cyan, magenta, and yellow inks are not limited to these black inks or the inks of low color material densities.

For example, instead of the black ink or the like, a special color ink such as an orange, green, or blue ink may be used to enlarge a color reproduction area for orange, green, or blue.

Further, inks may be added to the cyan, magenta, and yellow inks in order to improve the gray level. For example, to improve the expression of a low-lightness yellow part, a low-lightness yellow or gray ink may be used in place of the black ink.

In this case, the difference in color between the forward scanning and the backward scanning can be reduced by asymmetrically arranging the ejection opening rows adjacent to the most inside rows of the other symmetrically arranged ejection opening rows.

As described above, in a configuration for bidirectional printing, it is possible to achieve high-speed and high-grade printing particularly with the reduced non-uniformity of the colors, while minimizing an increase in the size of the printing head even if special inks are used to enlarge the color reproduction area or improve the gray level.

As described above, according to the embodiments of the present invention, the ejection openings of the printing head are arranged so that between ejection openings for two predetermined different inks included in the predetermined symmetrically arranged ejection openings for which the manner of overlapping can be controlled to remain unchanged between the forward scanning and the backward scanning, an ejection opening except the predetermined symmetrical ejection openings is located. This reduces the difference in the color of a dot formed when the manner of superposing the ink ejected from the ejection opening except the predetermined symmetrical ejection openings and the inks ejected from the predetermined symmetrically arranged ejection openings varies between the forward scanning and the backward scanning.

As a result, in an ink jet printing apparatus using many types of inks to execute bidirectional printing, it is possible to achieve high-speed and high-grade printing particularly by reducing the non-uniformity of colors attributed to the bidirectional printing, while minimizing an increase in the size of the printing head.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. An ink jet printing apparatus that uses a printing head and scans the printing head along a main scanning direction over a printing medium in forward and backward directions so that during each of a forward scan and a backward scan of the printing head, dots are formed with a plurality of types of ink ejected from ejection openings of the printing head so as to perform printing to the printing medium, wherein the printing head arranges a plurality of ejection opening rows, each of which arranges a plurality of ejection openings in a direction different from the main scanning direction, wherein the plurality of ejection opening rows includes a plurality of sets of ejection opening rows of a plurality of colors, each set including two ejection opening rows of a particular color, arranged symmetrically in the main scanning direction so that one predetermined set of two ejection opening rows of a particular color is arranged in an innermost position with other sets of ejection opening rows symmetrically arranged with one ejection opening row on each side of the predetermined set, wherein the plurality of ejection opening rows includes a set of ejection opening rows corresponding to a color different from the plurality of colors, the ejection opening rows being positioned on one side of and adjacent to the predetermined set of two ejection opening rows of a particular color so that there is no intervening ejection opening row of the color different from the plurality of colors as between the two ejection opening rows of the predetermined set, and wherein the plurality of colors include yellow, magenta and cyan and the color different from the plurality of colors is black.

2. A printing head used by an ink jet printing apparatus that scans the printing head along a main scanning direction over a printing medium in forward and backward directions so that during each of a forward scan and a backward scan of the printing head, dots are formed with a plurality of types of ink ejected from ejection openings of the printing head so as to perform printing to the printing medium, wherein the printing head arranges a plurality of ejection opening rows, each of which arranges a plurality of ejection openings in a direction different from the main scanning direction, wherein the plurality of ejection opening rows includes a plurality of sets of ejection opening rows of a plurality of colors, each set including two ejection opening rows of a particular color, arranged symmetrically in the main scanning direction so that one predetermined set of two ejection opening rows of a particular color is arranged in an innermost position with other sets of ejection opening rows symmetrically arranged with one ejection opening row on each side of the predetermined set, wherein the plurality of ejection opening rows includes a set of ejection opening rows corresponding to a color different from the plurality of colors, the ejection opening rows being positioned on one side of and adjacent to the predetermined set of two ejection opening rows of a particular color so that there is no intervening ejection opening row of the color different from the plurality of colors as between the two ejection opening rows of the predetermined set, and wherein the plurality of kinds of color colors include yellow, magenta and cyan and the color different from the plurality of kinds of color colors is black.

* * * * *